US011351428B2

(12) United States Patent
Brown

(10) Patent No.: US 11,351,428 B2
(45) Date of Patent: Jun. 7, 2022

(54) LACROSSE HEAD WITH ENHANCED POCKET CHANNEL AND SWEET SPOT

(71) Applicant: Wm. T. Burnett IP, LLC, Baltimore, MD (US)

(72) Inventor: Austin Scott Brown, Glen Rock, PA (US)

(73) Assignee: W.m. T. Burnett IP, LLC, Baltimore, MD (US)

( * ) Notice: Subject to any disclaimer, the term of this patent is extended or adjusted under 35 U.S.C. 154(b) by 0 days.

(21) Appl. No.: 16/420,533

(22) Filed: May 23, 2019

(65) Prior Publication Data

US 2020/0368594 A1 Nov. 26, 2020

(51) Int. Cl.
*A63B 59/20* (2015.01)
*A63B 102/14* (2015.01)

(52) U.S. Cl.
CPC ..... *A63B 59/20* (2015.10); *A63B 2102/14* (2015.10)

(58) Field of Classification Search
CPC ..... A63B 59/20; A63B 2102/14
See application file for complete search history.

(56) References Cited

U.S. PATENT DOCUMENTS 2,039,138 A 4/1936 Auer
2,142,527 A 1/1939 Pool
2,205,706 A * 6/1940 Wolff ..... A01K 77/00 210/495
2,508,519 A 5/1950 Jay
3,507,495 A 4/1970 Tucker et al.
3,992,008 A * 11/1976 Watkin ..... A63B 60/08 473/513
4,034,984 A 7/1977 Crawford et al.
4,097,046 A * 6/1978 Friant ..... A63B 60/00 473/513
4,138,111 A 2/1979 Rule
D263,249 S * 3/1982 Rule ..... D21/724
(Continued)

OTHER PUBLICATIONS

Federation of International Lacrosse 2018-2019 Womens Official Rules, Electronic Online Edition, Jan. 1, 2019.
(Continued)

*Primary Examiner* — Melba Bumgarner
*Assistant Examiner* — Amir A Klayman
(74) *Attorney, Agent, or Firm* — Plumsea Law Group, LLC

(57) ABSTRACT

Embodiments provide a lacrosse head with an enhanced pocket channel and sweet spot. The head includes first and second tabs protruding rearwardly from the rearward face of the transverse wall, with the transverse wall defining at least one inner pocket member opening disposed between first and second outer pocket member openings on the respective tabs. A first rearwardmost pocket-supporting edge of the first tab, a second rearwardmost pocket-supporting edge of the at least one inner pocket member opening, and a third rearwardmost pocket-supporting edge of the second tab may lie on an arc shape that is more curved than the curved shape of the transverse wall, to provide a cylindrically-shaped pocket channel. Each sidewall may have a rearward lower edge portion that extends generally parallel to the horizontal centerline and an intermediate lower edge portion that rapidly descends to a lowest point, to enhance the sweet spot of the head.

18 Claims, 14 Drawing Sheets

(56) References Cited

U.S. PATENT DOCUMENTS

D277,691 S * 2/1985 Rule ..... D21/724
5,035,434 A 7/1991 Taylor et al.
5,048,843 A 9/1991 Dorfi et al.
5,054,790 A 10/1991 Brine, III et al.
5,082,290 A * 1/1992 Tucker ..... A63B 59/20 473/513
5,174,580 A * 12/1992 Pratt ..... A63B 59/20 473/513
5,178,397 A 1/1993 Brine, Jr.
5,290,039 A 3/1994 Cornelio
5,494,297 A 2/1996 MacNeil
5,566,947 A 10/1996 Tucker et al.
5,568,925 A 10/1996 Morrow et al.
D376,183 S 12/1996 Morrow et al.
5,651,549 A 7/1997 Dill et al.
5,651,744 A 7/1997 Millon et al.
5,685,791 A * 11/1997 Feeney ..... A63B 49/10 473/513
5,935,026 A 8/1999 Dill et al.
5,967,912 A 10/1999 Hexemer et al.
6,283,879 B1 9/2001 Eden et al.
6,561,932 B2 5/2003 Morrow et al.
6,723,134 B2 4/2004 Tucker, Sr.
6,752,730 B1 6/2004 Brine, Jr. et al.
6,764,417 B1 * 7/2004 Filippini ..... A63B 49/022 473/540
6,916,259 B2 7/2005 Kohler et al.
6,923,739 B2 8/2005 Gait et al.
7,101,294 B2 9/2006 Tucker, Sr.
D534,227 S 12/2006 Lee
7,201,678 B2 4/2007 Filice et al.
7,214,150 B2 5/2007 Filice et al.
7,214,151 B1 * 5/2007 Gait ..... A63B 59/20 473/513
7,278,936 B2 * 10/2007 Tucker, Jr. ..... A63B 51/02 473/513
D565,140 S 3/2008 Appleton et al.
7,338,396 B2 * 3/2008 Gait ..... A63B 59/20 473/513
D567,890 S 4/2008 Appleton et al.
7,357,739 B2 4/2008 Montano et al.
7,404,775 B2 7/2008 Morrow et al.
7,407,455 B2 * 8/2008 Tucker, Jr. ..... A63B 59/20 473/513
D581,475 S 11/2008 Dickie et al.
7,488,266 B2 2/2009 Tucker, Jr. et al.
D589,101 S 3/2009 Dickie et al.
D589,102 S 3/2009 Dickie et al.
7,520,828 B2 * 4/2009 Tucker, Sr ..... A63B 59/20 473/513
7,588,506 B1 9/2009 Gait
7,618,335 B2 * 11/2009 Brown ..... A63B 59/20 473/513
D606,146 S 12/2009 Gedeon
7,682,269 B1 * 3/2010 Gait ..... A63B 59/20 473/513
7,727,093 B2 6/2010 Lamson et al.
7,766,772 B2 8/2010 Morrow et al.
7,798,923 B2 9/2010 Herman et al.
8,016,701 B2 * 9/2011 Lamson ..... A63B 49/028 473/513
8,052,549 B2 11/2011 Sykora
8,109,846 B2 2/2012 Schmidt et al.
D670,347 S * 11/2012 Goudy ..... D21/753
D688,342 S 8/2013 Tucker, Jr. et al.
8,827,849 B2 9/2014 Spiegel
D723,639 S 3/2015 Gait et al.
D723,640 S 3/2015 Paquette et al.
D724,682 S 3/2015 McPhail et al.
D735,281 S 7/2015 Janisse et al.
D735,282 S 7/2015 Burns et al.
9,149,695 B2 10/2015 Evans
9,220,963 B2 12/2015 Miceli et al.
9,259,883 B1 2/2016 Morrow et al.
9,522,315 B2 12/2016 Ruyssenaars et al.
9,643,311 B1 5/2017 Cowie
9,656,136 B2 5/2017 Van Alen et al.
10,357,692 B1 7/2019 Whitney et al.
10,493,339 B2 12/2019 Gait et al.
10,688,357 B2 6/2020 Kohler et al.
10,765,924 B2 9/2020 Brown et al.
2004/0053714 A1 3/2004 Gait et al.
2005/0043123 A1 2/2005 Harvey
2006/0040771 A1 2/2006 Filice et al.
2006/0194655 A1 8/2006 Tucker, Sr. et al.
2007/0178995 A1 8/2007 Schmidt et al.
2008/0051229 A1 2/2008 DeVoe et al.
2008/0268988 A1 10/2008 Lamson et al.
2008/0293524 A1 11/2008 Gait
2009/0111618 A1 4/2009 Schmidt
2009/0298623 A1 12/2009 Schmidt
2010/0113191 A1 5/2010 Winningham et al.
2010/0190590 A1 * 7/2010 Sobel ..... A63B 59/20 473/513
2011/0136600 A1 6/2011 Schmidt
2012/0071280 A1 3/2012 Copeland et al.
2012/0205268 A1 8/2012 Kreger et al.
2012/0283052 A1 11/2012 Tucker, Jr. et al.
2013/0244816 A1 9/2013 Lignelli et al.
2013/0274036 A1 * 10/2013 Spiegel ..... A63B 47/02 473/513
2014/0323249 A1 10/2014 Miceli et al.
2015/0190691 A1 * 7/2015 Colchie ..... A63B 60/00 473/513
2016/0199710 A1 7/2016 Barnhart
2017/0021244 A1 1/2017 Colchie
2017/0189772 A1 * 7/2017 Paquette ..... A63B 59/20
2017/0232315 A1 8/2017 Brown
2018/0001167 A1 1/2018 Miceli et al.
2018/0001168 A1 * 1/2018 Kennedy ..... A63B 65/122
2018/0065013 A1 * 3/2018 Rocas ..... A63B 63/00
2018/0133570 A1 5/2018 McDonell et al.
2018/0333621 A1 11/2018 Coe et al.
2019/0046852 A1 2/2019 Brown et al.
2019/0282872 A1 * 9/2019 Ling ..... A63B 59/20
2020/0261780 A1 8/2020 Whitney et al.

OTHER PUBLICATIONS

NCAA Men's Lacrosse 2019 and 2020 Rules, Oct. 2018.
NCAA Women's Lacrosse 2018 and 2019 Rules, Dec. 2017.
NCAA Men's Lacrosse 2017 and 2018 Rules, Oct. 2016.
Adidas EQT Enrayge Lacrosse Head, Apr. 8, 2016 [retrieved Jan. 8, 2019]. Retrieved from the Internet: <https://web.archive.org/web/20160408052151/http://www.adidas.com/us/eqt-enrayge-lacrosse-head/AI7192.html>.
Adidas EQT Bawse Lacrosse Head, Apr. 8, 2016 [retrieved Jan. 8, 2019]. Retrieved from the Internet: <https://web.archive.org/web/20160408060307/http://www.adidas.com/us/eqt-bawse-lacrosse-head/AI7230.html>.
STX Raptor Complete Stick, SidelineSwap, 1990s [retrieved Jan. 8, 2019], Retrieved from the Internet: <https://sidelineswap.com/gear/lacrosse/complete-sticks/432264-stx-raptor-complete-stick>.
Maverik Tactik Lacrosse Head, Universal Lacrosse, Jul. 10, 2016 [retrieved Jan. 8, 2019], Retrieved from the Internet: <https://web.archive.org/web/20160710140212/http://www.universallacrosse.com:80/maverik-tactik-lacrosse-head.html>.
StringKing Mark 2V Head Review, New England Lacrosse Blog, Mar. 9, 2017 [retrieved Jan. 8, 2019]. Retrieved from the Internet: <http://nelaxblog.com/2017/03/09/stringking-mark-2v-head-review/>.
String King Mark 2D Strung Lacrosse Head, Mar. 8, 2017 [retrieved Jan. 8, 2019], Retrieved from the Internet: <https://web.archive.org/web/20170308012128/https://www.stringitup.com/string-king-mark-2d-strung-black/>.
StringKing Mark 2V: Grossman, Henry, Huppmann Reviews, Inside Lacrosse, Mar. 9, 2017 [retrieved Jan. 8, 2019. Retrieved from the Internet: <https://www.insidelacrosse.com/article/stringking-mark-2v-grossman-henry-huppmann-reviews/48625>.

(56) References Cited

OTHER PUBLICATIONS

STX Stallion 700 Lacrosse Head, Oct. 29, 2016 [retrieved Jan. 8, 2019]. Retrieved from the Internet: <https://web.archive.org/web/20161029101102/https://www.lax.com/lacrosse-equipment/stx-stallion-700-head>.
Nike Lunar Head Women's Lacrosse Heads, May 1, 2016 [retrieved May 1, 2018], Retrieved from the Internet: <http:web.archive.org/web/20160501071443/https://www.lax.com/lacrosse-equipment/nike-lunar-23>.
Excerpt of 2015 STX Lacrosse Catalog, Women's Performance Guide, 11 pages.
Brine Mantra 3 Women's Lacrosse Head, Lacrosse Monkey, Dec. 30, 2014 [retrieved Jun. 12, 2018]. Retrieved from the Internet: <https://web.archive.org/web/20141230053141/https://www.lacrossemonkey.com/brine-lacrosse-women-head-mantra-3.html>.
Future of Women's Attack Stick?, STX Crux 500 and Maverik Erupt, Universal Lacrosse Blog, Sep. 11, 2015 [retrieved Jun. 12, 2018]. Retrieved from the Internet: <https://web.archive.org/web/20150911044841/http://www.universallacrosse.com/wp/future-of-womens-attack-stick/>.
Maverik Erupt Complete Lacrosse Stick, Longstreth, Feb. 15, 2016 [retrieved Jun. 12, 2018]. Retrieved from the Internet: <https://web.archive.org/web/20160215171557/https://www.longstreth.com/Maverik-Erupt-Complete-Lacrosse-Stick/productinfo/LAMECS/>.
STX Crux 500, Universal Lacrosse, Oct. 21, 2014 [retrieved Jun. 12. 2018]. Retrieved from the Internet: <https://web.archive.org/web/20141021143407/http://www.universallacrosse.com/crux-500-black-black.html>.
Office Action dated Nov. 23, 2018 in U.S. Appl. No. 15/949,132.
Epoch Lacrosse, Gen 4 Technology, web page, May 17, 2014. Available from Internet: <https://web.archive.org/web/20140517033525/https://www.epochlacrosse.com/gen-4-technology/>.
Amendment filed Feb. 25, 2019 in U.S. Appl. No. 15/949,132.
Final Office Action dsted Jun. 12, 2019 in U.S. Appl. No. 15/949,132.
Office Action dated Jun. 13, 2019 in U.S. Appl. No. 16/059,506.
Office Action dated Jul. 22, 2019 in Design U.S. Appl. No. 29/633,840.
Design U.S. Appl. No. 29/633,840, filed Jan. 16, 2018.
NCAA Women's Lacrosse 2016 and 2017 Rules, Nov. 2015.
Amendment filed Oct. 15, 2019 in U.S. Appl. No. 15/949,132.
Amendment filed Dec. 12, 2019 in U.S. Appl. No. 16/059,506.
Interview Summary dated Feb. 26, 2020 in U.S. Appl. No. 15/949,132.
Interview Summary dated Sep. 11, 2019 in U.S. Appl. No. 15/949,132.
Office Action dated Mar. 5, 2020 in U.S. Appl. No. 15/949,132.
Interview Summary dated Jun. 17, 2020 in U.S. Appl. No. 15/949,132.
Amendment filed Jul. 6, 2020 in U.S. Appl. No. 15/949,132.
Interview Summary dated Sep. 9, 2019 in U.S. Appl. No. 16/059,506.
Office Action dated Mar. 24, 2020 in U.S. Appl. No. 16/059,506.
Interview Summary dated Jun. 17, 2020 in U.S. Appl. No. 16/059,506.
Amendment filed Jun. 24, 2020 in U.S. Appl. No. 16/059,506.
Amendment after Final filed Dec. 16, 2020 in U.S. Appl. No. 15/949,132.
Advisory Action dated Jan. 13, 2021 in U.S. Appl. No. 15/949,132.
Amendment Accompanying Request for Continued Examination filed Feb. 17, 2021 in U.S. Appl. No. 15/949,132.
Request for Reconsideration filed Nov. 24, 2020 in U.S. Appl. No. 16/059,506.
Advisory Action dated Dec. 14, 2020 in U.S. Appl. No. 16/059,506.
Notice of Appeal dated Dec. 28, 2020 in U.S. Appl. No. 16/059,506.
Pre-Appeal Brief Request for Review filed Dec. 28, 2020 in U.S. Appl. No. 16/059,506.
Notice of Panel Decision dated Jan. 27, 2021 in U.S. Appl. No. 16/059,506.
Office Action dated Apr. 23, 2021 in U.S. Appl. No. 16/059,506.
Office Action dated Jul. 14, 2021 in U.S. Appl. No. 15/949,132.

* cited by examiner

LACROSSE HEAD WITH ENHANCED POCKET CHANNEL AND SWEET SPOT

BACKGROUND

Field

The present embodiments relate generally to lacrosse equipment, and more particularly, to a lacrosse stick head having an enhanced pocket channel and sweet spot. In embodiments, a lacrosse head may have rearwardly protruding stringing tabs, descending intermediate lower sidewall edge portions, and ascending forward lower sidewall edge portions, which may form a cylindrically-shaped channel and a well-defined sweet spot in a pocket, to enhance ball control during throwing, catching, and cradling.

Background

Lacrosse players favor lacrosse stick head pockets that provide control in catching, throwing, and cradling a lacrosse ball. Characteristics of a pocket that affect such performance include the shape, structure, and tension of the stringing materials. Typically, preferred pockets provide a structure that guides a ball into and out of the pocket along a centerline of the lacrosse head, for accuracy in catching and throwing.

SUMMARY

Embodiments provide a lacrosse stick head having an enhanced pocket channel and sweet spot.

An embodiment provides a lacrosse head having a juncture, a stop member, first and second sidewalls, a transverse wall, and first and second tabs. The juncture may be configured to receive a handle, a majority length of the handle defining a horizontal centerline when the lacrosse head is viewed from a side view and a bisecting line when the lacrosse head is viewed from a front view. The stop member may adjoin the juncture. The first sidewall may extend from the stop member in a forward direction. The second sidewall may extend from the stop member in the forward direction. The transverse wall may connect the first sidewall and the second sidewall opposite to the stop member, may have a forward face and a rearward face, and may have a curved shape when viewed from the front view. The stop member, the transverse wall, the first sidewall, and the second sidewall may form a pocket area. The adjoining transverse wall and first sidewall may form a first shoulder portion of the lacrosse head and the adjoining transverse wall and second sidewall may form a second shoulder portion of the lacrosse head. The first tab may protrude rearwardly from the rearward face of the transverse wall into the pocket area, may be disposed between the bisecting line and the first shoulder portion, and may define a first outer pocket member opening. The second tab may protrude rearwardly from the rearward face of the transverse wall into the pocket area, may be disposed between the bisecting line and the second shoulder portion, and may define a second outer pocket member opening. The transverse wall may define at least one inner pocket member opening that extends from the rearward face to the forward face and is disposed between the first outer pocket member opening and the second outer pocket member opening. A first rearwardmost pocket-supporting edge of the first tab, a second rearwardmost pocket-supporting edge of the at least one inner pocket member opening, and a third rearwardmost pocket-supporting edge of the second tab may lie on an arc shape that is more curved than the curved shape of the transverse wall.

In an aspect, a first upper surface of the first tab and a second upper surface of the second tab may be substantially flat and may lie in a horizontal plane generally parallel to the horizontal centerline.

In another aspect, a first upper surface of the first tab and a second upper surface of the second tab may be upwardly inclined in a forward-to-rearward direction.

In another aspect, the lacrosse head may include a pocket strung to the first outer pocket member opening, the at least one inner pocket member opening, and the second outer pocket member opening. The first rearwardmost pocket-supporting edge of the first tab, the second rearwardmost pocket-supporting edge of the at least one inner pocket member opening, and the third rearwardmost pocket-supporting edge of the second tab may form a cylindrically-shaped channel in the pocket.

In another aspect, each of the first sidewall and the second sidewall may have a rearward lower edge portion, a forward lower edge portion, and an intermediate lower edge portion between the rearward lower edge portion and the forward lower edge portion. The pocket may be strung to the first sidewall and the second sidewall. The intermediate lower edge portion may descend from the rearward lower edge portion in a rearward-to-forward direction to a maximum depth. The forward lower edge portion may ascend from the maximum depth in the rearward-to-forward direction. The intermediate lower edge portion may hold the pocket so that the pocket descends to a sweet spot below a transition point between the intermediate lower edge portion and the forward lower edge portion. The forward lower edge portion may hold the pocket so that the pocket ascends from the sweet spot to the cylindrically-shaped pocket channel.

In another aspect, the rearward lower edge portion may define at least three stringing openings to which the pocket is attached, may extend substantially parallel to the horizontal centerline for the at least three stringing openings, and may be disposed above the intermediate lower edge portion and the stop member.

In another aspect, each of the first tab and the second tab may have an inner member, an outer member, and a pocket thread support member connecting the inner member and the outer member. The inner member and the outer member may protrude from the rearward face of the transverse wall in a rearward direction.

In another aspect, the inner member and the outer member may increase in transverse cross-sectional area in a rearward-to-forward direction.

In another aspect, a forward end of the inner member and a forward end of the outer member may be inclined to match an angle of the rearward face of the transverse wall.

In another aspect, each of the forward end of the inner member and the forward end of the outer member may have a flared portion that curves downwardly into the face of the transverse wall.

In another aspect, the inner member and the outer member may be disposed above a continuous rearward edge of the transverse wall.

In another aspect, the inner member of the first tab and the inner member of the second tab may be angled outwardly in a forward-to-rearward direction. The inner member of the first tab, the inner member of the second tab, and a rearward edge of the transverse wall may define an upper perimeter of a pocket channel.

In another aspect, each of the first tab and the second tab may have a brace member attached to a forward end of the outer member and extending laterally outward along the rearward face of the transverse wall.

In another aspect, the brace member may decrease in transverse cross-sectional area down to a point at a lateral end of the brace member.

In another aspect, the first tab and the second tab may each have a concave rearwardmost edge configured to support a pocket stringing member.

In another aspect, an upper edge of the transverse wall may extend from the first shoulder portion to the second shoulder portion and lie in a plane generally horizontal to the horizontal centerline.

Another embodiment provides a lacrosse head having a juncture, stop member, first and second sidewalls, and a transverse wall. The juncture may be configured to receive a handle, with a majority length of the handle defining a horizontal centerline when the lacrosse head is viewed from a side view and a bisecting line when the lacrosse head is viewed from a front view. The stop member may adjoin the juncture. The first and second sidewalls may extend from the stop member in a forward direction. The transverse wall may connect the first sidewall and the second sidewall opposite to the stop member and may define a terminal contact point along the bisecting line. The stop member, the transverse wall, the first sidewall, and the second sidewall may form a pocket area. The adjoining transverse wall and first sidewall may form a first shoulder portion of the lacrosse head and the adjoining transverse wall and second sidewall may form a second shoulder portion of the lacrosse head. Each of the first sidewall and the second sidewall may have a rearward lower edge portion, a forward lower edge portion, and an intermediate lower edge portion between the rearward lower edge portion and the forward lower edge portion. The rearward lower edge portion, the forward lower edge portion, and the intermediate lower edge portion may define stringing openings configured to receive a pocket. The rearward lower edge portion may extend substantially parallel to the horizontal centerline for the at least three stringing openings. The rearward lower edge portion may be disposed above the intermediate lower edge portion and the stop member. The intermediate lower edge portion may descend at an angle within a range of about 10 degrees to about 20 degrees with respect to the horizontal centerline, from the rearward lower edge portion in a rearward-to-forward direction to a maximum depth. The terminal contact point may be disposed a distance vertically above the maximum depth within a range of about 58 mm to about 67 mm. The forward lower edge portion may ascend at an angle within a range of about 40 degrees to about 50 degrees with respect to the horizontal centerline, from the maximum depth in the rearward-to-forward direction. The intermediate lower edge portion may be configured to hold the pocket so that the pocket descends to a sweet spot below a transition point between the intermediate lower edge portion and the forward lower edge portion. The forward lower edge portion may be configured to hold the pocket so that the pocket ascends from the sweet spot toward the transverse wall.

In an aspect, the lacrosse head may also include a first tab and a second tab. The first tab may protrude rearwardly from a rearward face of the transverse wall into the pocket area, may be disposed between the bisecting line and the first shoulder portion, and may define a first outer pocket member opening. The second tab may protrude rearwardly from the rearward face of the transverse wall into the pocket area, may be disposed between the bisecting line and the second shoulder portion, and may define a second outer pocket member opening. The transverse wall may define at least one inner pocket member opening that extends from the rearward face of the transverse wall to a forward face of the transverse wall and is disposed between the first outer pocket member opening and the second outer pocket member opening. A first rearwardmost pocket-supporting edge of the first tab, a second rearwardmost pocket-supporting edge of the at least one inner pocket member opening, and a third rearwardmost pocket-supporting edge of the second tab may lie on an arc shape that is more curved than a curved shape of the transverse wall when viewed from the front view. The arc shape may be configured to hold the pocket with a cylindrically-shaped channel formed in the pocket, with the cylindrically-shaped channel leading in a forward-to-rearward direction to the sweet spot.

In another aspect, the first tab may have an upper forwardmost edge attached to the rearward face of the transverse wall at a first distance above the horizontal centerline, the first pocket-supporting rearwardmost edge of the first tab may be disposed at a second distance above the horizontal centerline, and the second distance may be equal to or greater than the first distance.

Another embodiment provides a lacrosse stick having a handle and a head. The head may have a juncture, a stop member, first and second sidewalls, a transverse wall, and first and second tabs. The handle may be disposed in the juncture, with a majority length of the handle defining a horizontal centerline when the lacrosse head is viewed from a side view and a bisecting line when the lacrosse head is viewed from a front view. The stop member may adjoin the juncture. The first and second sidewalls may extend from the stop member in a forward direction. The transverse wall may connect the first sidewall and the second sidewall opposite to the stop member, may have a forward face and a rearward face, and may have a curved shape when viewed from the front view. The stop member, the transverse wall, the first sidewall, and the second sidewall may form a pocket area. The adjoining transverse wall and first sidewall may form a first shoulder portion of the lacrosse head and the adjoining transverse wall and second sidewall may form a second shoulder portion of the lacrosse head. The first tab may protruded rearwardly from the rearward face of the transverse wall into the pocket area, may be disposed between the bisecting line and the first shoulder portion, and may define a first outer pocket member opening. The second tab may protrude rearwardly from the rearward face of the transverse wall into the pocket area, may be disposed between the bisecting line and the second shoulder portion, and may define a second outer pocket member opening. The transverse wall may define at least one inner pocket member opening that extends from the rearward face to the forward face and is disposed between the first outer pocket member opening and the second outer pocket member opening. A first rearwardmost pocket-supporting edge of the first tab, a second rearwardmost pocket-supporting edge of the at least one inner pocket member opening, and a third rearwardmost pocket-supporting edge of the second tab may lie on an arc shape that is more curved than the curved shape of the transverse wall.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
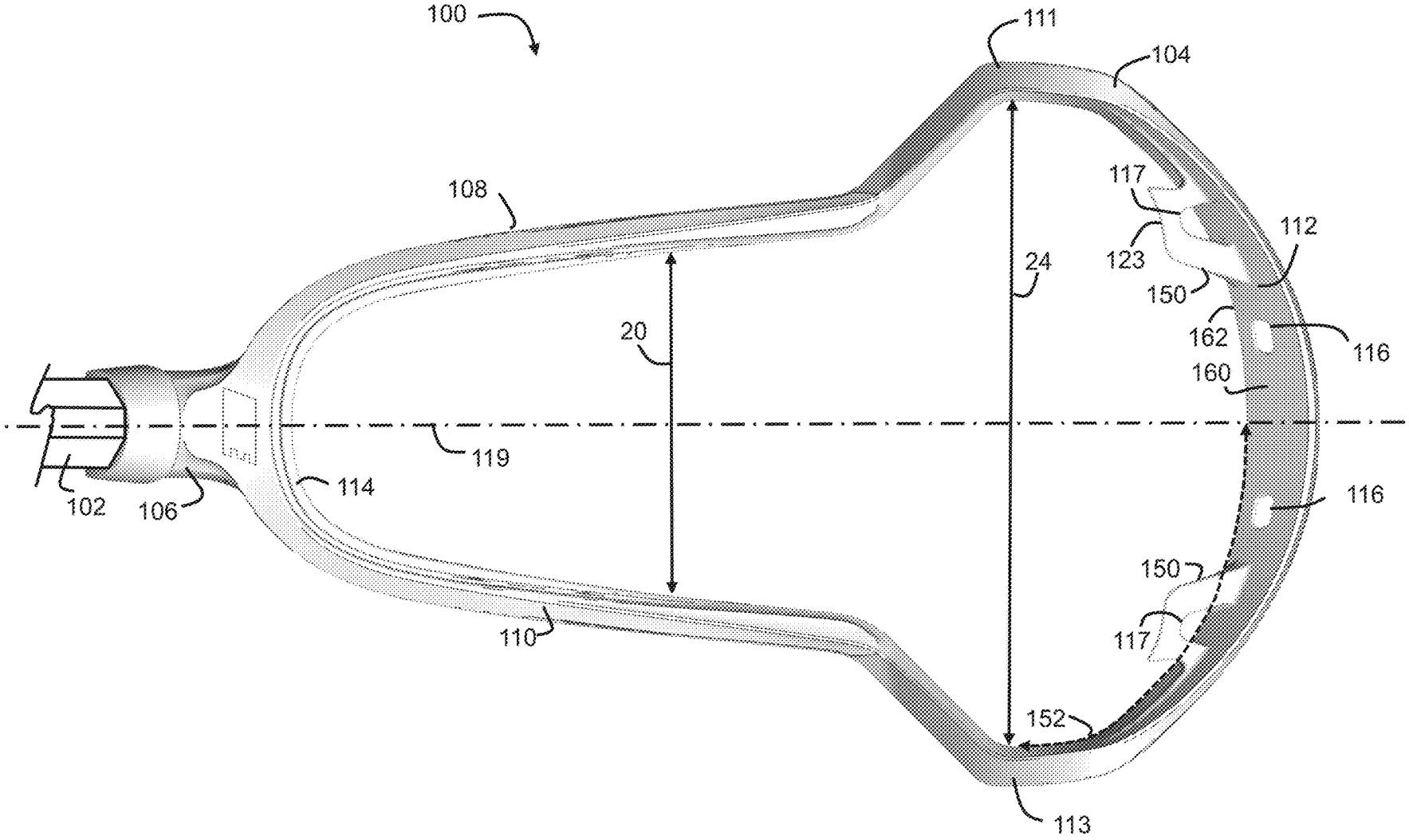
FIG. 1 is a schematic diagram of a front view of a lacrosse stick providing an enhanced pocket channel and sweet spot, according to an embodiment.

Embodiments provide a lacrosse head having an enhanced pocket channel and sweet spot. The enhanced pocket channel may be formed by lateral stringing tabs that protrude rearwardly of the transverse wall (or "scoop") and rearwardly of one or more transverse wall stringing openings disposed between the lateral stringing tabs. The relative positions of the lateral stringing tabs and transverse wall stringing openings may hold stringing members in a pronounced cylindrically-shaped channel in the forward portion of the lacrosse head. The cylindrically-shaped pocket channel may extend rearwardly to a desirable sweet spot, generally located at a maximum depth of the pocket disposed beneath a lowest point of the frame of the lacrosse head. To further enhance the sweet spot, each sidewall of the lacrosse head may have a rearward portion with a lower edge that extends generally parallel to the horizontal centerline and an intermediate portion with a lower edge that rapidly descends to the lowest point of the frame. A pocket strung to the parallel lower edge and to the abruptly descending lower edge may provide a shorter and more well-defined sweet spot in conjunction with the cylindrically-shaped pocket channel on the opposite side. As used herein, the sweet spot of a lacrosse stick head may be considered a location at or near a transition point in the sidewall at which a maximum pocket depth is achieved and maximum ball hold is realized.

FIGS. 1-8 illustrate a representative embodiment of a lacrosse stick 100, including a handle 102 (partially shown) and a double-wall synthetic head 104. As used herein, "stick" refers to the stick as a whole, including the head and the handle. Head 104 may have a generally V-shaped frame having a juncture 106, sidewalls 108 and 110, a transverse wall (or "scoop") 112 joining the sidewalls at their ends opposite juncture 106, and a stop member (or "ball stop") 114 adjoining juncture 106 and joining sidewalls 108 and 110 at their ends nearest juncture 106. The frame may be considered to extend from a rearward end at the juncture 106 to a forward end at the transverse wall 112. As shown in FIGS. 1-4, handle 102 may fit into and through juncture 106, may abut stop member 114, and may define (by a majority length of handle 102) a horizontal centerline 121 of the handle 102 and head 104 as shown, for example, in the side elevational views of FIGS. 3 and 4, as well as a longitudinal bisecting line 119 as shown, for example, in the front view of FIG. 1 and rear view of FIG. 2 (bisecting the head 104 longitudinally into two halves). Screws or other fasteners may be placed through one or more openings 107 in juncture 106, securing handle 102 to head 104. Features of lacrosse sticks are shown generally in Tucker et al., U.S. Pat. No. 3,507,495, Crawford et al., U.S. Pat. No. 4,034,984, and Tucker et al., U.S. Pat. No. 5,566,947, which are all incorporated by reference herein.

In embodiments, lacrosse stick head 104 may have a "traditional" pocket configuration, a "mesh" pocket configuration, or a combination of the two configurations. The traditional pocket may include thongs made of leather or synthetic material strung from stringing openings, or thong holes, at forward portions of the head 104 to rearward stringing openings or thong holes 118 in stop member 114. In embodiments, referring to FIG. 1, the thong holes at forward portions of the head 104 may include forward thong holes 116 in transverse wall 112 and forward thong holes 117 formed by tabs 150. Transverse wall 112 may define holes 116 from rearward face 160 to forward face 161. To complete the pocket web, the thongs may have nylon strings threaded around the thongs and string laced through stringing openings in sidewalls 108 and 110, forming any number of diamonds or other shapes (crosslacing).

Figure 2:
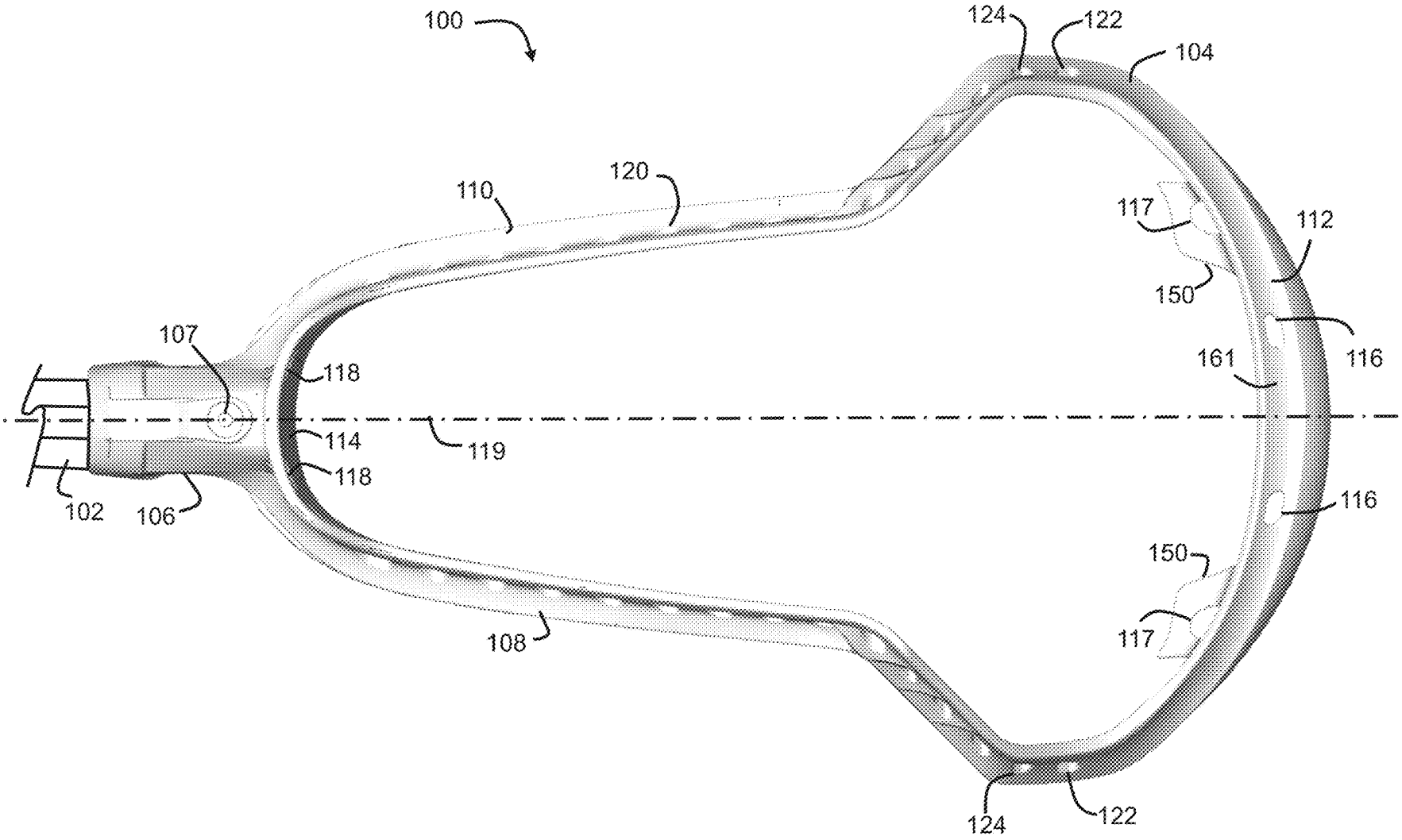
FIG. 2 is a schematic diagram of a rear view of the lacrosse stick of FIG. 1.

In traditional pockets, thongs (not shown in FIGS. 1-8) made of leather or synthetic material may extend from forward thong holes 116, 117 to rearward thong holes 118 in stop member 114 (see, e.g., FIG. 2). As one embodiment, FIGS. 1-8 show four pairs of thong holes (116, 117, 118) that may accept four thongs. Other numbers of thongs and thong holes may be used. To complete the pocket web, nylon strings may be threaded around the thongs and string may be laced through stringing openings 120 in sidewalls 108 and 110, forming any number of diamonds or other shapes (crosslacing). In embodiments, one or more throwing or shooting strings may extend transversely between the forward portions of sidewalls 108 and 110, attaching to throwing stringing openings 124 and a string laced through stringing openings 122. In embodiments, a thong may not be attached directly to a stringing opening, and instead may be connected to a separate material that attaches the thong to the lacrosse head frame and that is easier to adjust through the stringing opening. In addition, in some embodiments, a top string (e.g., nylon string) may be strung along the forward thong holes 116, 117, and the thongs may be attached to the top string.

A mesh pocket configuration may use a mesh knitted as a continuous piece of material. This continuous piece of material may attach to the lacrosse head as a single unit. The mesh may be attached to the lacrosse head using transverse lacing, which may reinforce the web of the mesh that is adjacent to the lacrosse head.

As exemplified in FIG. 1, embodiments may include provisions for improving the performance of a lacrosse stick, especially within the context of rules governing the configuration of a women's lacrosse head. In particular, certain rules for women's lacrosse (e.g., NCAA Women's Lacrosse 2018 and 2019 Rules, Appendix E, Section 24) require that the combined height of the sidewall and the depth of the pocket containing the ball shall not exceed 6.4 cm (the diameter of the ball) and that the top of a ball, when placed in the pocket of a horizontally held crosse, must be visible/seen above the top of the entire sidewall after reasonable force with one hand has been applied to and released from the ball. Other rules for women's lacrosse (e.g., NCAA Women's Lacrosse 2018 and 2019 Rules, Appendix E, Section 5) require that an unstrung head lie within a 6.55 cm horizontal plane, such that a maximum height point of a head is no more than 6.55 cm above a lowest point of the head. With reference to FIG. 1, other rules for women's lacrosse (e.g., NCAA Women's Lacrosse 2018 and 2019 Rules, Appendix E, Section 18.d and 18.e) require that the inside width 20 between the sidewalls 108 and 110 of the head 104, as measured a distance of 10.2 cm (102 mm) from the center of ball stop 114, be 8.7 cm minimum, and that the inside width between the walls at the widest point 24 at the top of the head 104 be a distance of 16.0 cm minimum. Certain rules also dictate that the overall length of the head, as measured from the center of the ball stop (where the top, back edge of the stop pad meets the plastic) to the top outside edge of the scoop, be a distance between 25.4 cm minimum to 30.5 cm maximum (e.g., NCAA Women's Lacrosse 2018 and 2019 Rule 2, Section 23). Other rules (e.g., NCAA Men's Lacrosse 2018 and 2019 Rules, Appendix IV) specify that a lacrosse ball may measure between 7¾ and 8 inches in circumference, which corresponds to a diameter within a range of 2.47 inches (62.7 mm) to 2.55 inches (64.8 mm).

Within one or more of those rule restrictions, embodiments may provide a favorable lacrosse head geometry that forms a pronounced cylindrically-shaped pocket channel, a more well-defined sweet spot, and a maximum-height release point based on a lowest point of a sidewall of the head and a highest point of a forward portion of the head, all of which may enhance hold and control of a ball through catching, cradling, and swinging motions, and facilitate higher shot speeds without sacrificing throwing accuracy.

Embodiments may provide a pronounced cylindrically-shaped pocket channel by the unique configuration and relative positions of forward stringing openings (e.g., thong holes) in a lacrosse head. For example, as shown in FIGS. 1 and 2, the rearwardmost edges 123 (e.g., over which a pocket member would be supported) of lateral outer thong holes 117 formed by tabs 150 may be disposed significantly rearward of the transverse wall 112 and the inner thong holes 116 formed by the transverse wall 112. In particular implementations, the rearwardmost edges 123 of thong holes 117 may be positioned within a range of about 5 mm to about 20 mm rearward of the face 160 of the transverse wall 112 measured in a direction generally parallel to the longitudinal bisecting line 119 and generally horizontal with respect to the horizontal line 121. The tabs 150 may protrude into the pocket within a range of about 10 mm to about 25 mm rearward of the rearward edge 162 of transverse wall 112 measured in a direction generally parallel to the longitudinal bisecting line 119. As shown in FIG. 1, tabs 150 may be located so that a thong hole 117 is disposed at approximately a midpoint of an arc 152 extending approximately from the longitudinal bisecting line 119 to widest point 24. With that configuration, a thong that is threaded through the thong hole 117 may be supported by the rearwardmost edge 123 of the tab 150 at position that is significantly more rearward of the inner thong holes 116 than would be an outer thong hole located in the transverse wall 112. In addition, as seen, for example, in FIG. 6, a support point 154 of the tab 150 may hold the end of a thong at an elevation considerably higher than would a thong hole placed in the transverse wall, and higher than the inner thong holes 116.

FIGS. 9-12 illustrate an embodiment of a pronounced cylindrically-shaped channel formed in a pocket by the lacrosse head 104 of FIGS. 1-8. As represented graphically in the front view of FIG. 9, thongs 900 may be attached to inner thong holes 116 of transverse wall 112 and outer thong holes 117 of tabs 150, which hold the ends of thongs 900 in an arc shape 902 at a highest point of the pocket. As shown, arc shape 902 may be more curved than the curved shape of the transverse wall 112. As shown in the corresponding cross-sectional view of FIG. 10, the support points 154 of the tabs 150 protrude in a rearward direction into the pocket to provide the arc shape 902. As represented by the arrow 906, the rearward position of the support point 154 may hold the thong 900 at a more rearward position and at a higher elevation, in comparison to a thong 908 (represented by the broken lines) strung to a conventional thong hole formed in the transverse wall 112 and supported at point 912. In other words, the rearward position of tabs 150 relative to inner thong holes 116 may hold the thongs 900 in a more arced channel, as compared to the flatter thong positions of conventional scoop thong holes.

Figure 10:
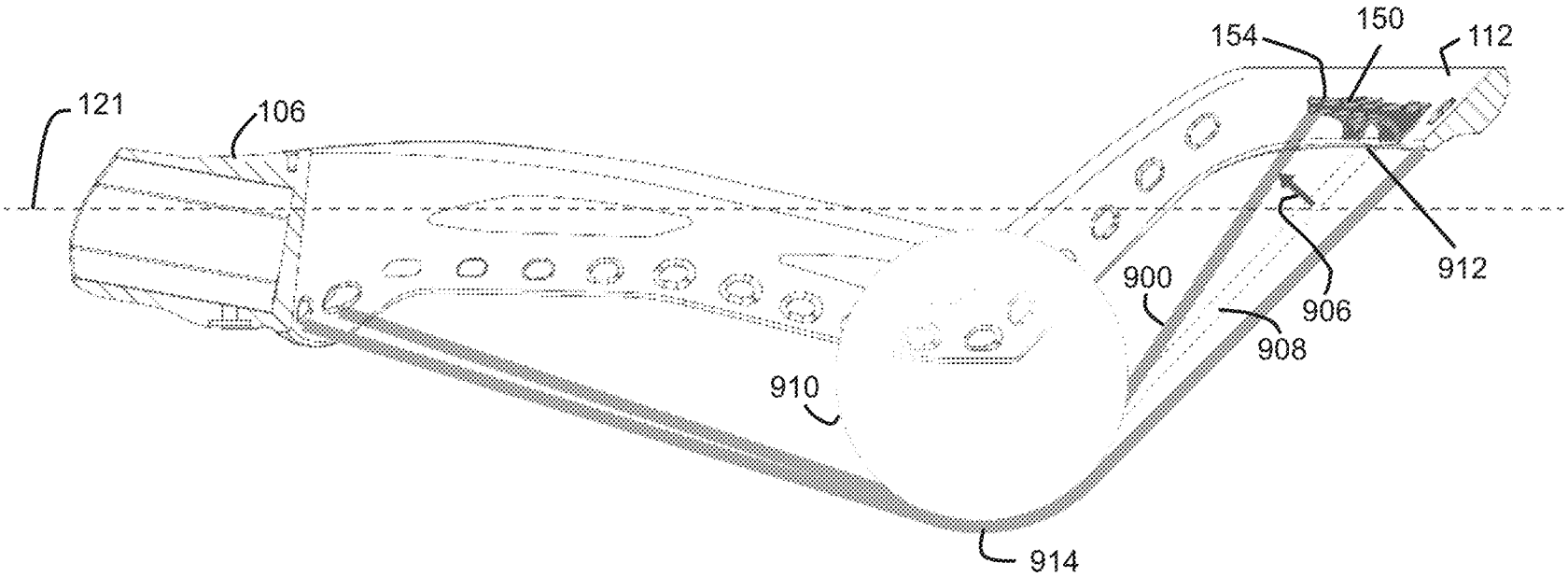
FIG. 10 is a schematic diagram of a cross-sectional view of the lacrosse stick head of FIG. 9, taken along line A-A of FIG. 9.
Figure 11:
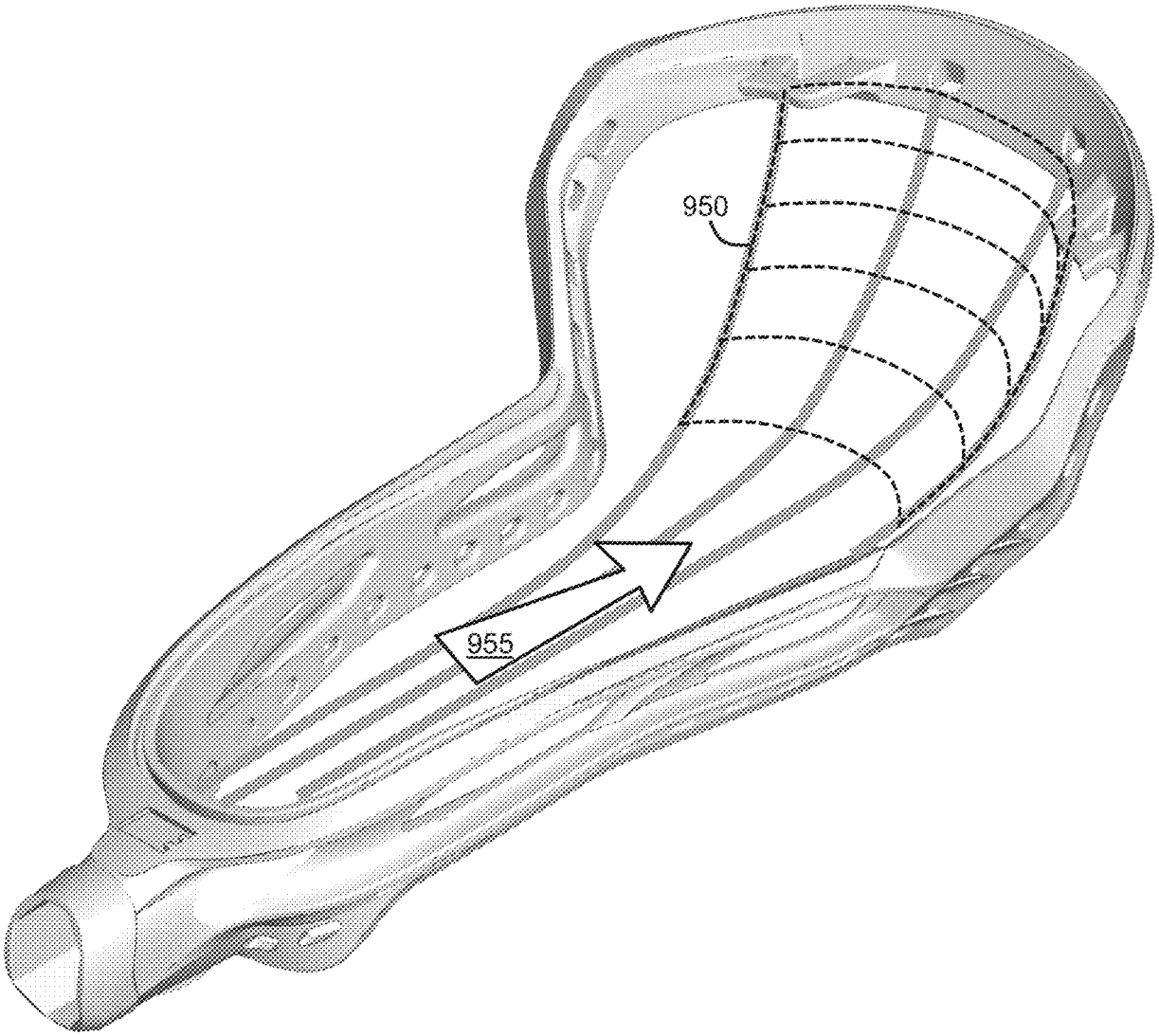
FIG. 11 is a schematic diagram of a top perspective view of a lacrosse stick head having a cylindrically-shaped pocket channel, according to an embodiment.
Figure 12:
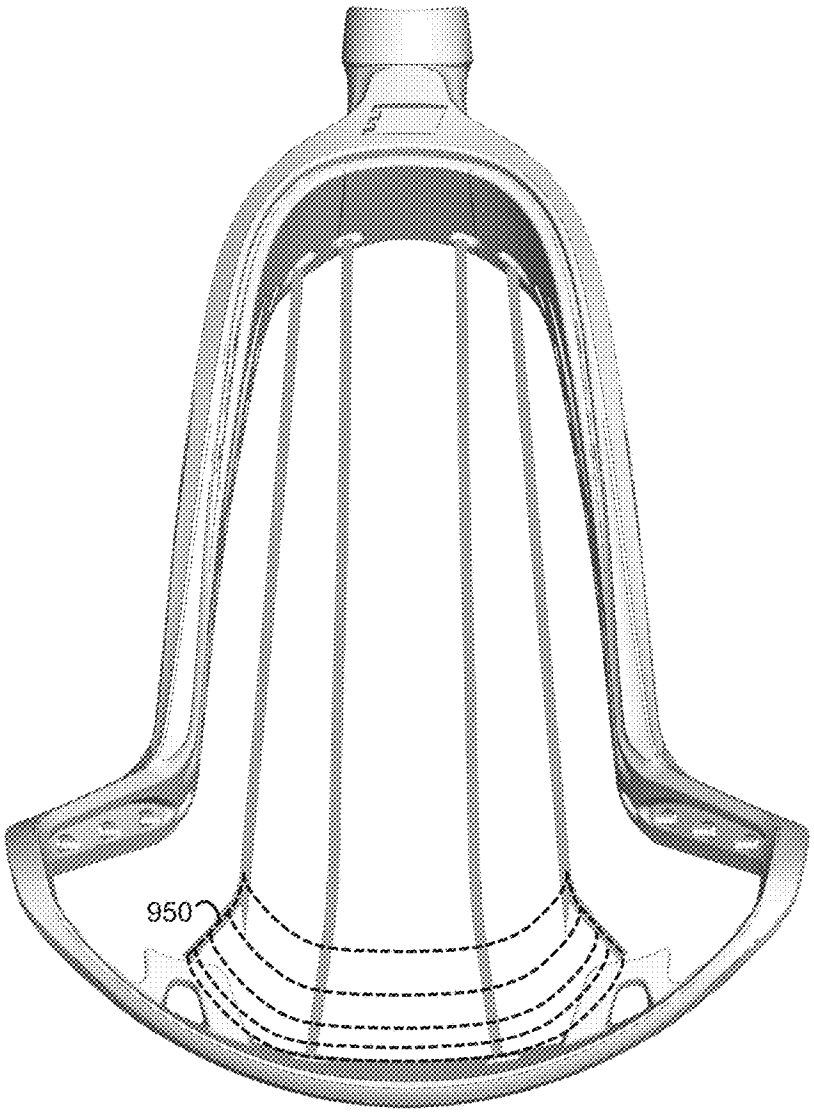
FIG. 12 is a schematic diagram of a top perspective view of the lacrosse stick head of FIG. 11.

With the ends of the thongs held in an arc shape 902, embodiments may form an accentuated cylindrically-shaped pocket channel 950, as graphically represented by the broken lines in FIGS. 11 and 12. The cylindrical shape of the pocket channel 950 may beneficially cup a lacrosse ball 910 as the ball travels longitudinally along the pocket during catching and throwing, and may favorably center the ball along the longitudinal bisecting line 119 for better control. As shown in FIG. 10, for example, pocket channel 950 may extend from the transverse wall 112 to a lowest point 914 of the pocket, which may be considered a sweet spot at which a ball 910 may naturally come to rest in the pocket. The lowest point 914 and sweet spot may be disposed in the forward portion of the head 104, forward of a midpoint between a forwardmost edge of the stop member 114 and the forwardmost edge of the transverse wall 112 along the longitudinal bisecting line 119. In embodiments, lowest point 914 and/or the center of ball 910 may be positioned a distance from the forwardmost edge of the stop member 114 that is within a range of about 50% to about 70% of the distance between the forwardmost edge of the stop member 114 and the forwardmost edge of the transverse wall 112, along the longitudinal bisecting line 119.

Although embodiments of FIGS. 9-12 illustrate traditional pockets with thongs, head 104 may also accommodate other types of pockets, such as mesh pockets, and still provide similar features and benefits. For example, attaching a mesh pocket to tabs 150 and inner thong holes 116 of head 104 may provide a similar cylindrically-shaped pocket channel by tensioning portions of the mesh material generally along the directions of the thongs shown in FIGS. 9-12. Thus, notwithstanding the particular features and benefits described herein with respect to traditional pockets, the embodiments of FIGS. 1-8 should be considered broadly applicable to any lacrosse head pocket material.

Figure 13:
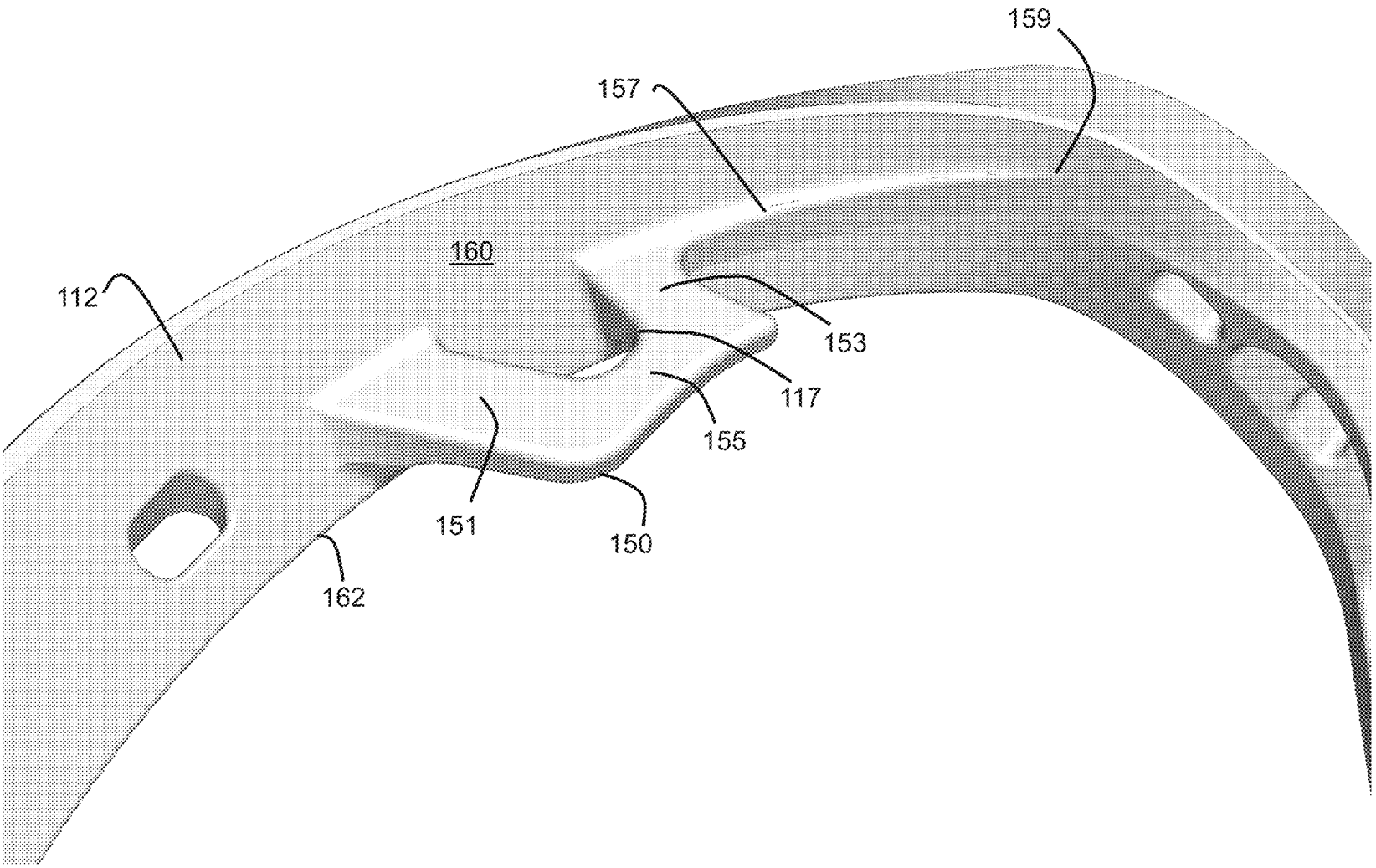
FIG. 13 is a schematic diagram of a partial top perspective view of a lacrosse stick head, showing an enlarged view of a transverse wall, tab, and shoulder, according to an embodiment.
Figure 14:
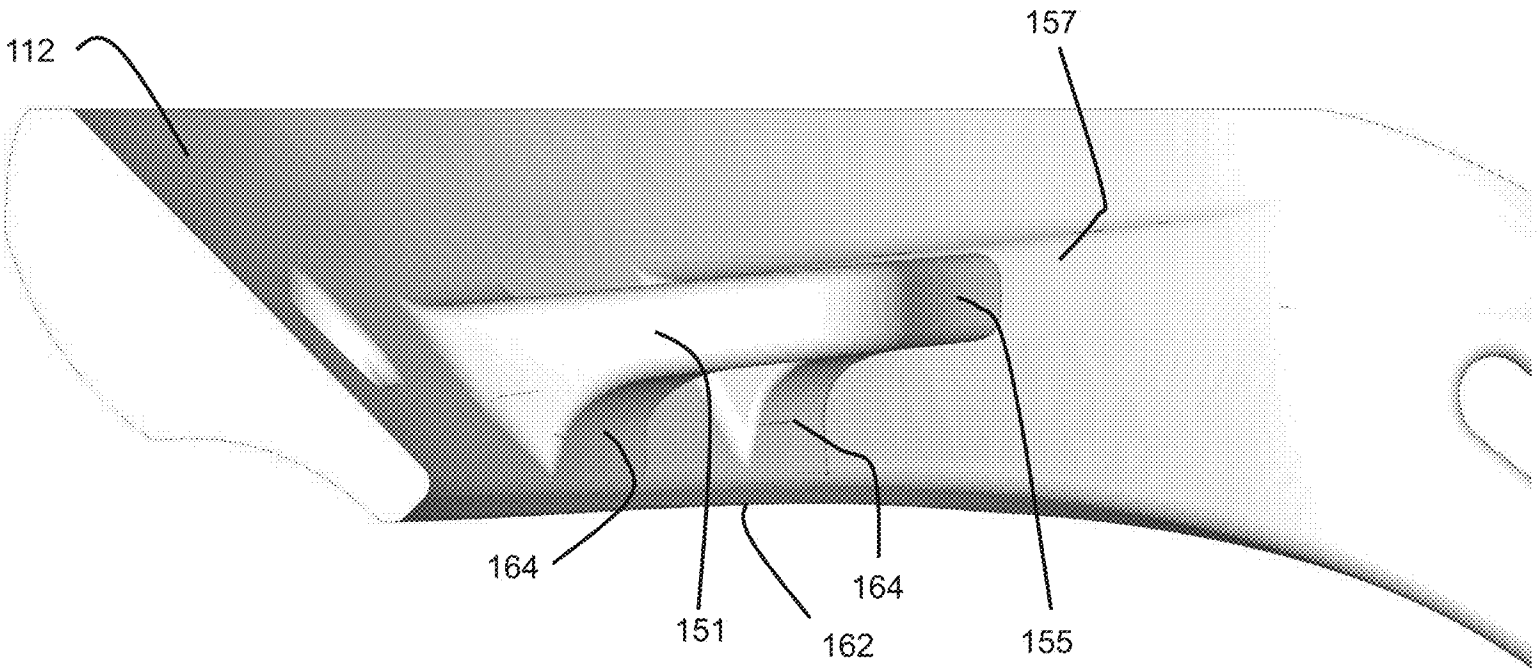
FIG. 14 is a schematic diagram of a partial cross-sectional view of the lacrosse stick head of FIG. 13, taken along a longitudinal bisecting line of the head, and showing the transverse wall, tab, and shoulder.

In holding pocket members in a desired arc-shaped position and forming a beneficial cylindrically-shaped pocket channel, embodiments of tabs 150 may include provisions for secure attachment to the transverse wall 112, for protruding rearwardly into the pocket at a relatively high elevation, for avoiding wear on the supported pocket material, and for providing further structural contours of a pocket channel. As shown in the enlarged partial view of FIG. 13, a tab 150 may include an inner member 151, an outer member 153, a pocket thread support member 155, and a brace member 157. Inner member 151 and outer member 153 may protrude from an interior portion of the rearward face 160 of transverse wall 112, disposed above a continuous rearward edge 162 of the transverse wall 112, as shown in FIGS. 13 and 14, for example. The rearward ends of inner member 151 and outer member 153 may be joined by pocket thread support member 155, with the members 151, 153, 155 and the rearward face 160 of the transverse wall 112 forming the thong hole 117.

For secure attachment to transverse wall 112, inner member 151 and outer member 153 may increase in transverse cross-sectional area (taken generally perpendicular to a longitudinal axis of a member) in a direction from their rearward ends to their forward ends where they attach to the transverse wall 112. In addition, as shown in FIG. 14, for example, the forward ends of inner member 151 and outer member 153 may be inclined to match the angle of the rearward face 160 of the transverse wall 112 and may have flared portions 164 that curve downwardly into the face 160 and provide upward structural support for the tab 150. For further structural support, embodiments may include a brace member 157 attached to the forward end of the outer member 153, and extending laterally outward along the rearward face 160 of the transverse wall 112. Starting from the outer member 153, brace member 157 may gradually decrease in transverse cross-sectional area down to a point at its lateral end 159.

The upper surfaces of the members 151, 153, 155 may be substantially flat and may lie in a horizontal plane generally parallel to the horizontal centerline 121, or in a plane that is slightly upwardly inclined in a forward-to-rearward direction, as shown in FIG. 14. The horizontal or upwardly inclined orientation may beneficially hold a pocket stringing member at a high elevation at point rearwardly inside the pocket, which may provide a desired pocket channel shape.

As shown in FIGS. 1, 7-9, 13, and 14, embodiments of tab 150 may include a pocket thread support member 155 having a rearward edge that is curved concavely. The concave curve may help center a pocket stringing member on the tab 150 and may help avoid wear on the suspended pocket stringing member.

In embodiments, tabs 150 may also further define a pocket channel by providing structural contours of the channel. For example, as shown in FIGS. 1, 2, 6-9, 13, and 14, inner members 151 of tabs 150 may be angled outwardly in a forward-to-rearward direction. With that configuration, the inner members 151, along with the rearward edge 162 of the transverse wall 112, may define an upper perimeter of the pocket channel, and may direct a ball entering the pocket toward the center of the pocket channel. The angled inner members 151 of the tabs 150 may therefore improve ball control during catching.

In alternative embodiments, tabs 150 may include the curved and angled features described above, but not necessarily on distinct members 151, 153, 155. For example, a tab may not have discernible members, and may instead have more continuous and/or rounded structures.

Further enhancing ball control, embodiments may include provisions for driving a ball within a pocket from a rearward portion of a head, such as near the stop member, to a lowest point or sweet spot of the pocket. In one embodiment, as shown, for example, in FIGS. 3 and 4, each of sidewalls 108, 110 may include a rearward lower edge portion 304 that extends approximately parallel to the horizontal centerline 121 and an intermediate lower edge portion 306 that rapidly descends from the rearward lower edge portion 304 to a maximum depth 308 of sidewalls 108, 110. The rearward lower edge portion 304 may be upwardly offset relative to the maximum depth 308 of sidewalls 108, 110 and relative to a lowermost point 302 of stop member 114. In embodiments, rearward lower edge portion 304 may extend approximately parallel to horizontal centerline 121 for at least three stringing openings 120. The parallel rearward lower edge portion 304 may allow head 104 to hold the pocket material higher (closer to horizontal centerline 121) at distances farther forward in the head 104. This higher and longer horizontal portion of the pocket may give the intermediate lower edge portion 306 a steep slope between the forward end of the parallel rearward lower edge portion 304 and the maximum depth 308, so as to provide a shorter, more well-defined sweet spot, which may provide better feel, control, and release of a ball.

In embodiments, from the maximum depth 308, sidewalls 108, 110 may have a transition point 309 at which the lower edges of sidewalls 108, 110 turn upward, with forward lower edge portions 312 ascending from maximum depth 308 to shoulder portions 111, 113. Maximum depth 308 may be in approximately the same horizontal plane 310 (which may be generally parallel to horizontal centerline 121) of, or slightly lower than, the lowermost point 302 of stop member 114. In an embodiment, the downward angle 142 of intermediate lower edge portion 306, as represented by dotted line 131, may be about 14 degrees with respect to horizontal centerline 121. In embodiments, the downward angle 142 may be within a range of about 8 degrees to about 20 degrees, which may favorably drive a ball toward the sweet spot in the forward portion of head 104 and to the base of the cylindrically-shaped pocket channel 950 as represented by the arrow 955 in FIG. 11. In this manner, the present embodiments may allow a player the benefit of efficiently moving the ball to the sweet spot of the pocket for a quicker, faster release from any angle.

Figure 3:
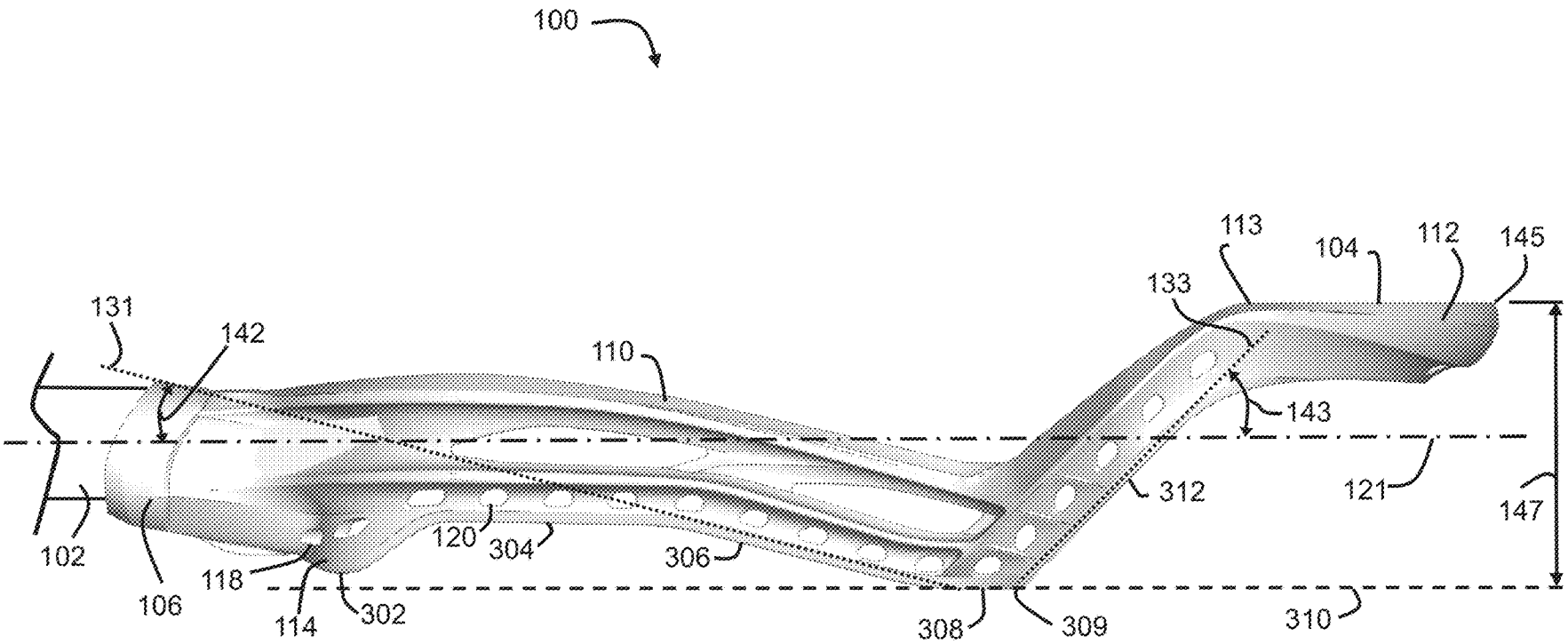
FIG. 3 is a schematic diagram of a side elevational view of the lacrosse stick of FIG. 1.

Further enhancing ball control, in embodiments, forward lower edge portions 312 of sidewalls 108, 110 may ascend at a steep angle in the forward direction from the maximum depth 308 to the shoulder portions 111, 113. For example, as shown in FIG. 3, upward angle 143 of forward lower edge portion 312, as represented by dotted line 133, may be about 46 degrees with respect to horizontal centerline 121. In embodiments, the upward angle 143 may be within a range of about 35 degrees to about 55 degrees, which may help form the pocket channel 950 described above.

Figure 4:
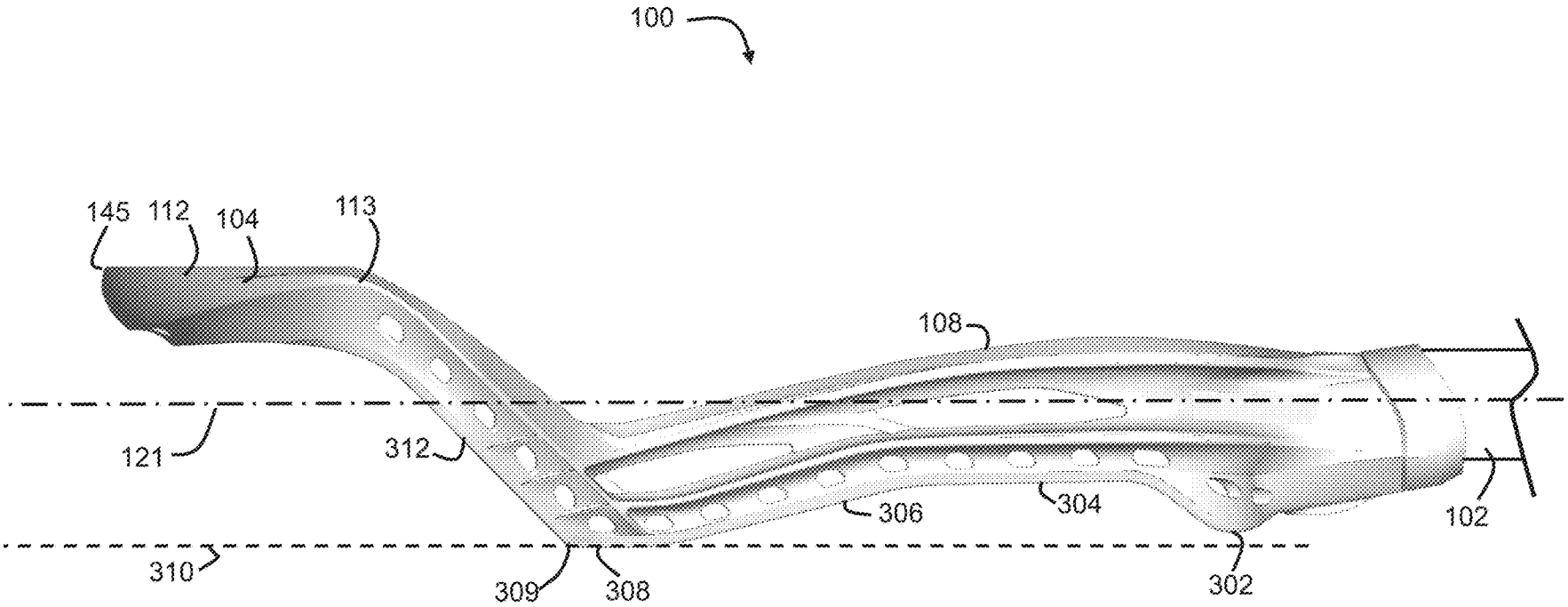
FIG. 4 is a schematic diagram of an opposite side elevational view of the lacrosse stick of FIG. 1.
Figure 5:
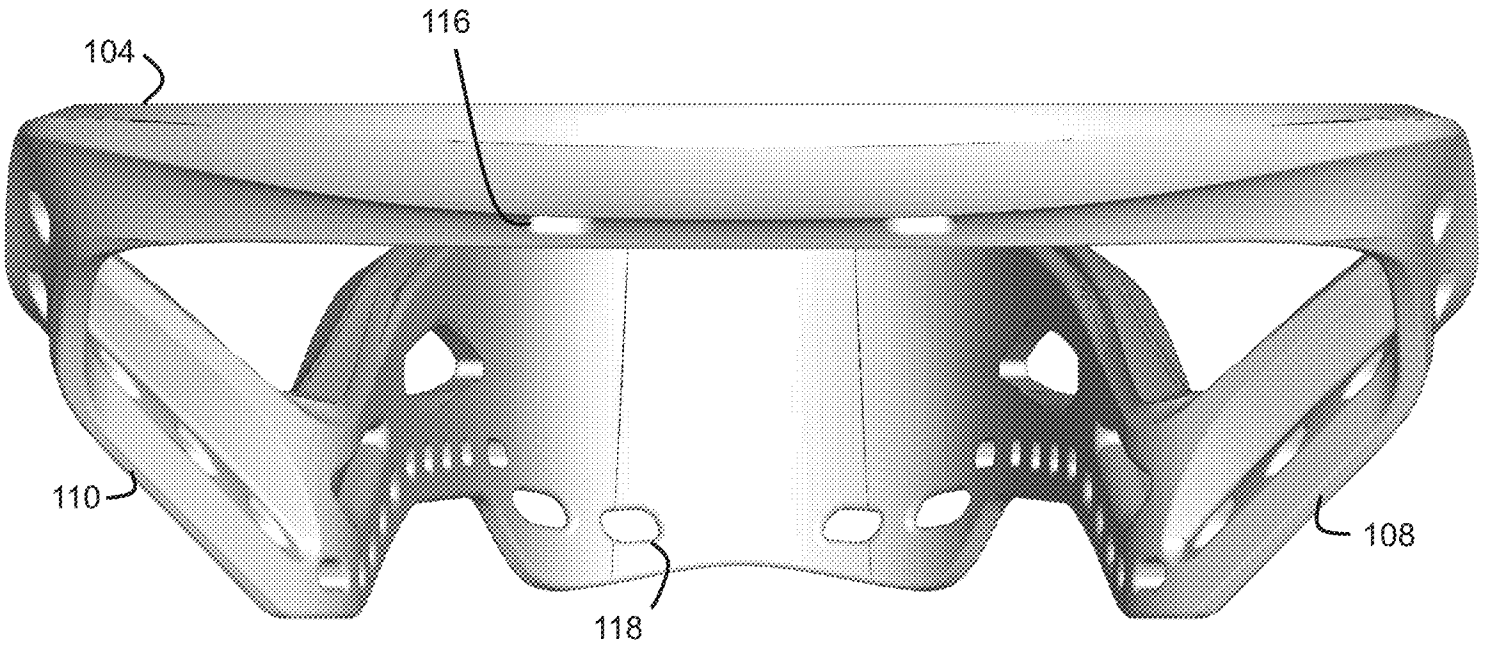
FIG. 5 is a schematic diagram of a top view of the lacrosse stick of FIG. 1.
Figure 6:
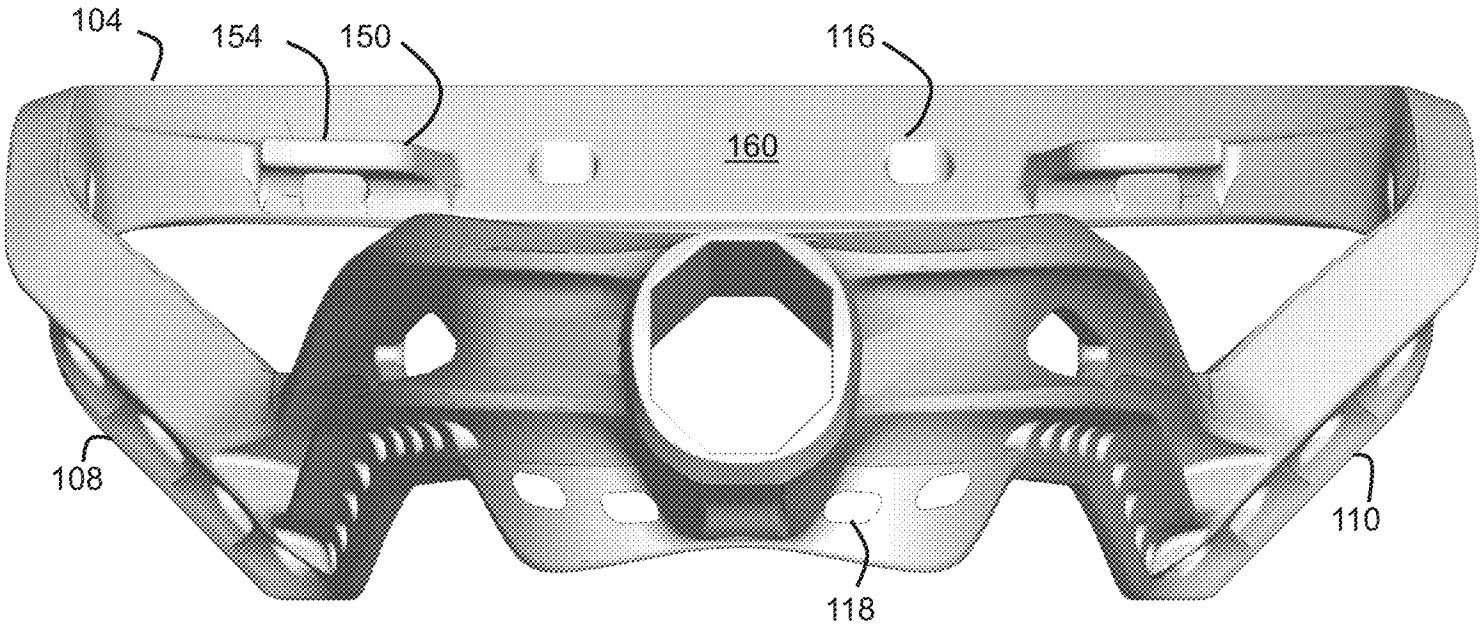
FIG. 6 is a schematic diagram of a bottom view of the lacrosse stick head of FIG. 1.
Figure 7:
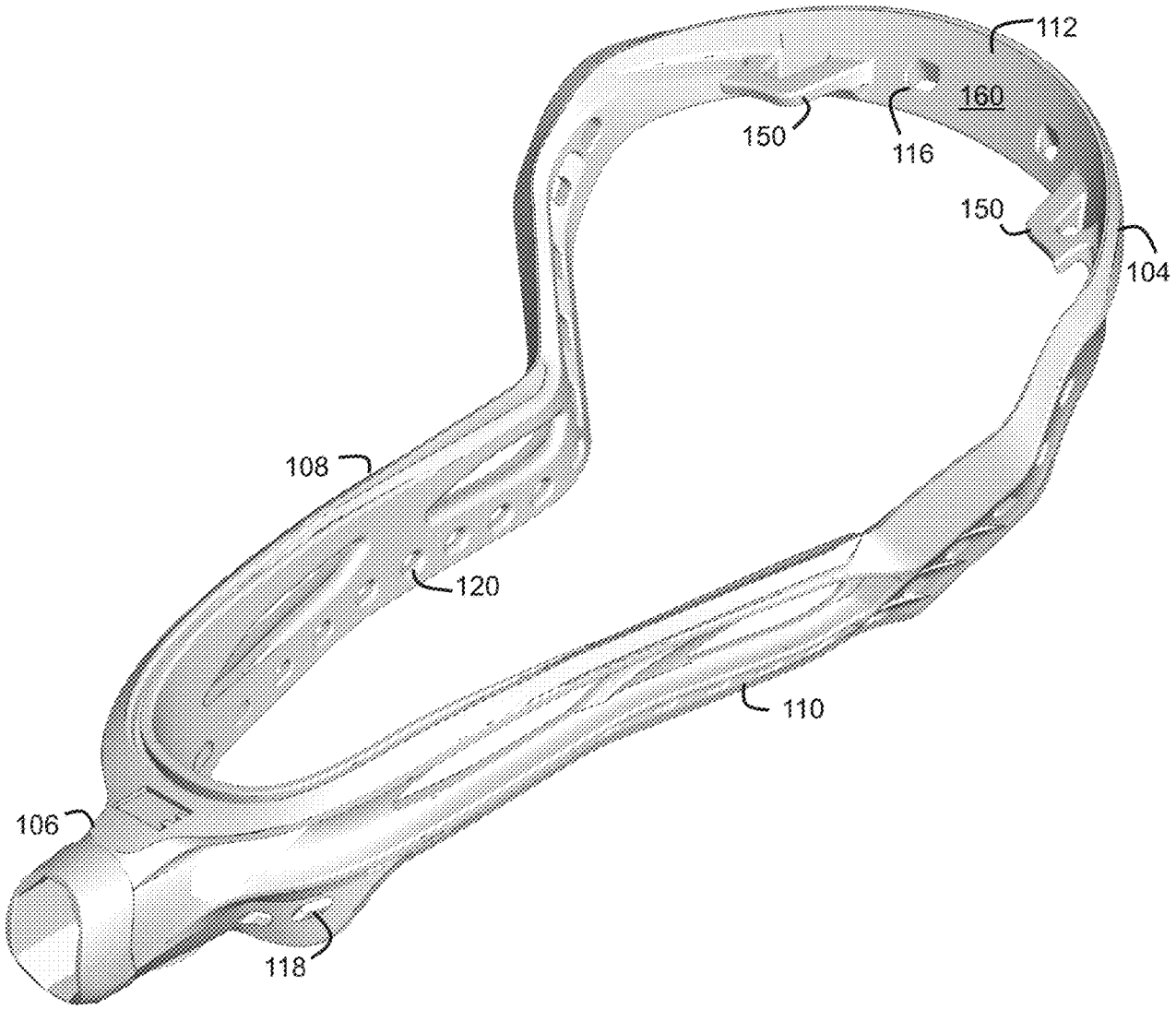
FIGS. 7 and 8 are schematic diagrams of top perspective views of the lacrosse stick head of FIG. 1
Figure 8:
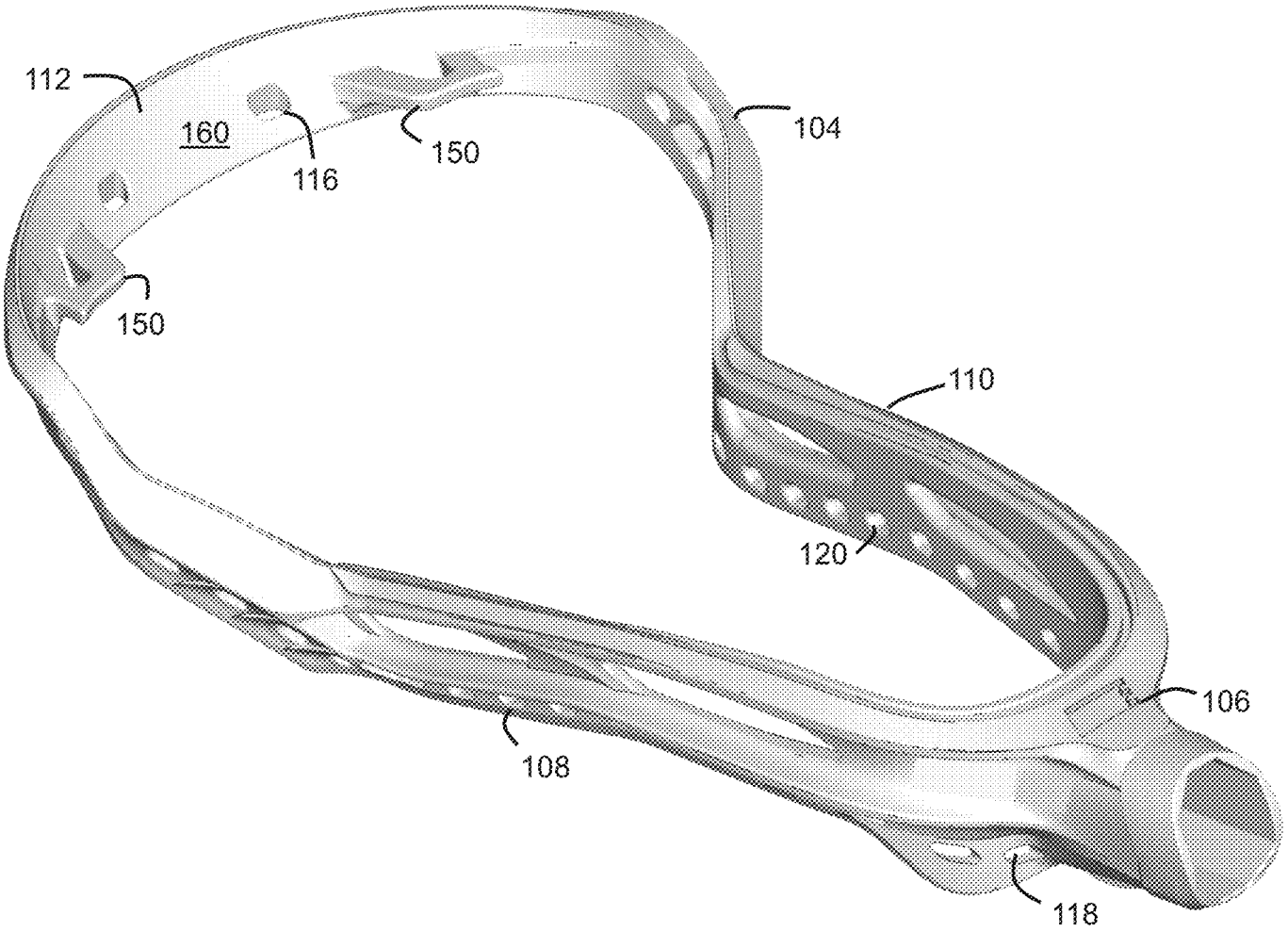
Figure 9:
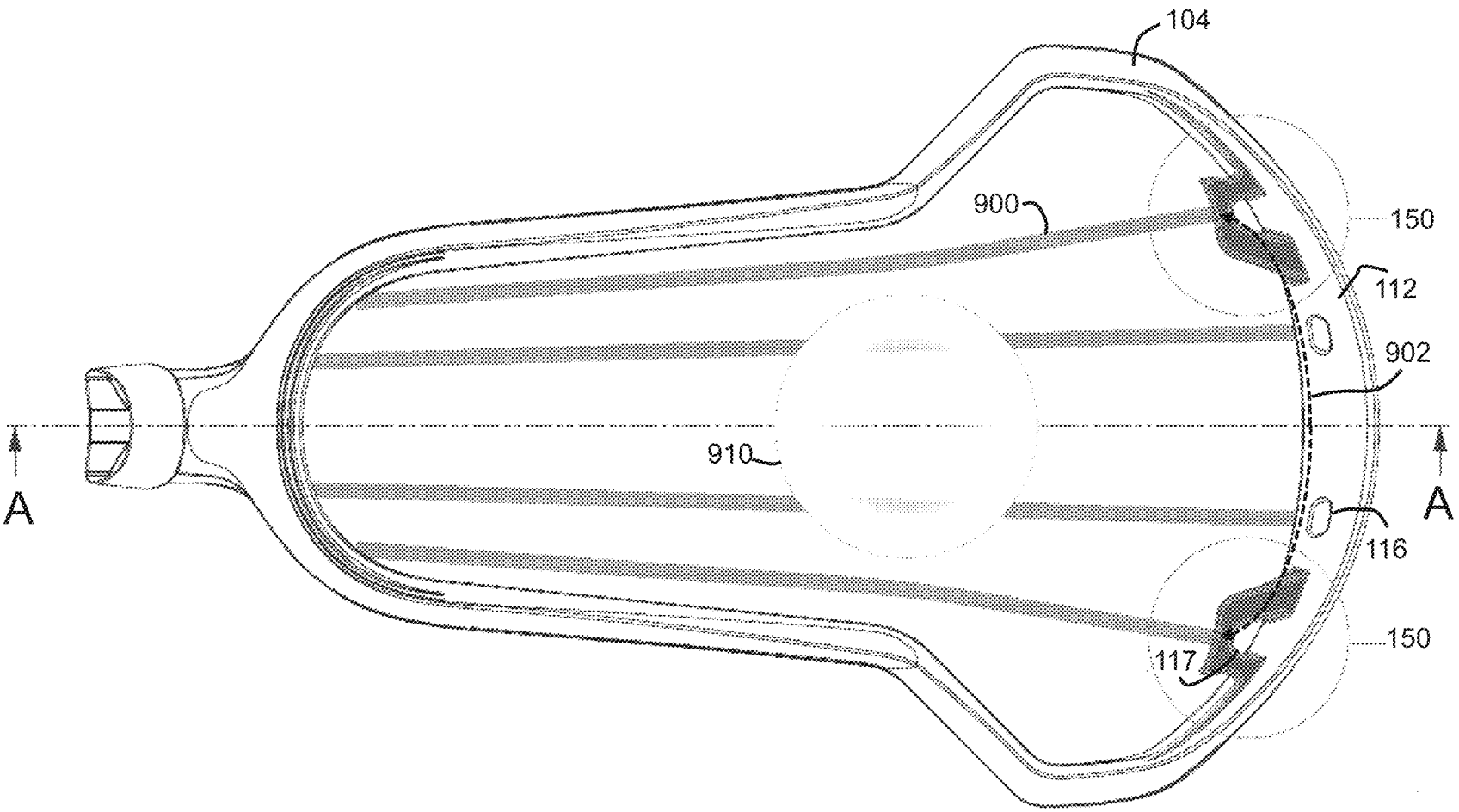
FIG. 9 is a schematic diagram of a front view of a lacrosse stick head with representative pocket members, shown with a ball, according to an embodiment.

As shown in FIGS. 3 and 4, in embodiments, transverse wall 122 may extend from shoulder portions 111, 113 with an upper edge that is substantially flat and parallel to the horizontal centerline 121. The flat and horizontal geometry may help position the tabs 150 at a flat and high elevation to provide a desired cylindrically-shaped pocket channel. As shown in FIGS. 10 and 14, for example, the tabs 150 may also be slightly inclined in a forward-to-rearward direction with respect to the horizontal centerline 121. Referring again to FIGS. 3 and 4, transverse wall 112 may define a terminal contact point 145 at which a ball traveling in a forward direction generally along longitudinal bisecting line 119 may last contact and release from the head during a throwing motion of the lacrosse stick 100. Terminal contact point 145 may be disposed at a highest and/or forwardmost point of lacrosse head 104. To accommodate rules limiting the overall height of a lacrosse head, terminal contact point 145 may be disposed a distance 147 vertically above maximum depth 308 within a range of about 58 mm to about 67 mm. In one implementation, distance 147 is approximately 64 mm. This geometry between a deepest sidewall point and a release point along a top center of a scoop may provide a longer diagonal distance between a forwardmost maximum sidewall depth and a release point, and a longer cylindrically-shaped pocket channel, so that a ball may travel farther to provide more shot speed.

The lacrosse head embodiments described herein may be configured to receive a straight handle or a bent handle. For example, as shown in the cross-sectional view of FIG. 10, an embodiment of a socket of the juncture 106 could be configured to receive a handle with an end portion bent at an angle of between about 1-10 degrees, with the horizontal centerline 121 corresponding to the centerline of the majority length of the handle. The bent handle configuration may provide the same benefits as a straight head-handle configuration, for example, in terms of an enhanced pocket channel and sweet spot, which facilitate ball control. Thus, in embodiments, a lacrosse stick having the features described herein may include configurations having a downwardly canted handle, examples of which are described in U.S. Pat. No. 7,488,266, issued Feb. 10, 2009, which is herein incorporated by reference in its entirety.

As used herein, the "centerline" refers to the centerline of the majority of a handle. In the case of a straight handle, the centerline coincides with the center longitudinal axis of the straight handle. In instances of handles having angled end portions inserted into lacrosse head frames, or in instances of angled throat sections of lacrosse heads, the centerline would be defined by the remaining majority length of the handle that extends away from the angled end portion or angled throat, and that is held by a player. For example, referring to FIG. 3, if handle 102 bends within the last few inches (e.g., 3 inches) of the end of the handle 102 at a 10 degree angle, with the bent end portion disposed inside the socket of throat 106, then that bent end portion is to be ignored for purposes of the centerline. Thus, in the example of FIG. 3, the horizontal line 121, which corresponds to the majority length of the handle 102, is the centerline for purposes of the present embodiments.

Examples of suitable materials for a lacrosse head according to the present embodiments include nylon, composite materials, elastomers, metal, urethane, polycarbonate, polyethylene, polypropylene, polyketone, polybutylene terephalate, acetals (e.g., Delrin™ by DuPont), acrylonitrile-butadiene-styrene (ABS), acrylic, acrylic-styrene-acrylonitrile (ASA), alcryn (partially crosslinked halogenated polyolefin alloy), styrene-butadiene-styrene, styrene-ethylene-butylene styrene, thermoplastic olefinic (TPO), thermoplastic vulcanizate (TPV), ethylene-propylene rubber (EPDM), and polyvinyl chloride (PVC). Examples of suitable materials for a handle according to the present embodiments include wood, metal (e.g., aluminum, titanium, scandium, CU31, C405, and C555), plastic, and composites.

As used herein, the term "point" refers generally to a dimensional position and not necessarily to a single point, and may include one or more points.

As used herein, the term "sidewall rail" refers generally to the edge or surface of a sidewall running along the upper or lower portion of the sidewall. In this respect, a sidewall rail does not have to be a bar-like member as illustrated in open-sidewall embodiments described herein, and could instead be an integral member of a closed sidewall configuration, in which the upper edge of the closed sidewall can be considered an upper sidewall rail and the lower edge of the closed sidewall can be considered a lower sidewall rail. In addition, a sidewall rail could also be both bar-like and integral in a partially open sidewall configuration, for example, where the openings do not extend the full length of the sidewall, or in areas where a sidewall typically decreases in height and assumes a solid construction through the height, such as near the stop member or the transverse wall. Accordingly, notwithstanding the particular embodiments illustrated herein, the term "sidewall rail" should be broadly interpreted to cover any upper or lower edge or surface portion of a sidewall.

For purposes of convenience various directional adjectives are used in describing the embodiments. For example, the description may refer to the top, bottom, and side portions or surfaces of a component. It may be appreciated that these are only intended to be relative terms and, for example, the top and bottom portions may not always be aligned with vertical up and down directions depending on the orientation of a component or lacrosse stick.

It should also be noted that relative terms such as "upper," "lower," "top," and "bottom," are used herein to describe the embodiments as depicted in the accompanying figures and are not intended to be limiting. Unless the context of the usage dictates otherwise, when used in reference to a lacrosse stick or head as a whole, the term "front" refers to the side of the lacrosse stick through which a ball is caught and the terms "back" and "rear" refer to the side of the lacrosse stick that is opposite to the "front" and is where the pocket is disposed. It should also be noted that figures provided herein generally depict the illustrated lacrosse head with the pocket side of the head (i.e., the rear) facing downward. It will be apparent to skilled practitioners that the orientation of a lacrosse stick varies dramatically during play and the relative positions of the elements of the present embodiments will similarly vary from those depicted.

The foregoing disclosure of the preferred embodiments has been presented for purposes of illustration and description. It is not intended to be exhaustive or to limit the embodiments to the precise forms disclosed. Many variations and modifications of the embodiments described herein will be apparent to one of ordinary skill in the art in light of the above disclosure.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

Further, in describing representative embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the present embodiments.

What is claimed is:

1. A lacrosse head, comprising:

a juncture configured to receive a handle, wherein a majority length of the handle defines a horizontal centerline of the handle and the lacrosse head when the lacrosse head is viewed from a side view and defines a bisecting line of the lacrosse head when the lacrosse head is viewed from a front view;

a stop member adjoining the juncture;

a first sidewall extending from the stop member in a rearward-to-forward direction;

a second sidewall extending from the stop member in the rearward-to-forward direction;

a transverse wall connecting the first sidewall and the second sidewall opposite to the stop member, wherein, when viewed from the front view, the transverse wall defines a rearward edge having a curved shape, wherein the stop member, the transverse wall, the first sidewall, and the second sidewall form a frame defining a pocket area, the frame extending in the rearward-to-forward direction from a rearward end at the juncture to a forward end at the transverse wall, wherein the transverse wall and the first sidewall adjoin each other to form a first shoulder portion of the frame on a first side of the bisecting line, and the transverse wall and the second sidewall adjoin each other to form a second shoulder portion of the frame on a second side of the bisecting line opposite to the first side, and wherein the transverse wall has a forward face and a rearward face;

a first tab protruding rearwardly from the rearward face of the transverse wall into the pocket area and disposed between the bisecting line and the first shoulder portion, wherein the first tab defines a first outer pocket member opening and a first rearward edge configured to support a pocket stringing member routed through the first outer pocket member opening, wherein, when viewed from the side view, the first tab defines a first flat upper surface that extends in a forward-to-rearward direction from a first upper forwardmost edge at the rearward face of the transverse wall, to the first rearward edge; and a second tab protruding rearwardly from the rearward face of the transverse wall into the pocket area and disposed between the bisecting line and the second shoulder portion, wherein the second tab defines a second outer pocket member opening and a second rearward edge configured to support a pocket stringing member routed through the second outer pocket member opening, wherein, when viewed from the side view, the second tab defines a second flat upper face that extends in the forward-to-rearward direction from a second upper forwardmost edge at the rearward face of the transverse wall, to the second rearward edge, wherein each of the first tab and the second tab has an inner member, an outer member, and a pocket thread support member connecting the inner member and the outer member, wherein the inner member and the outer member protrude from the rearward face of the transverse wall in the forward-to-rearward direction, and wherein a forward end of the inner member and a forward end of the outer member are inclined in the rearward-to-forward direction to match an angle of the rearward face of the transverse wall, wherein the transverse wall defines at least one inner pocket member opening that extends from the rearward face to the forward face, and when viewed from the front view, the at least one inner pocket member opening is disposed between the first outer pocket member opening and the second outer pocket member opening, and wherein the transverse wall defines a third rearward edge of the at least one inner pocket member opening configured to support a pocket stringing member routed through the at least one inner pocket member opening, wherein, when viewed from the front view, the first rearward edge of the first tab, the third rearward edge of the at least one inner pocket member opening, and the second rearward edge of the second tab lie on an arc shape, wherein, when viewed from the front view, the first rearward edge of the first tab and the second rearward edge of the second tab are disposed rearward of the rearward edge of the transverse wall such that the arc shape is more curved than the curved shaped of the rearward edge of the transverse wall, and wherein when viewed from the side view:

the first flat upper surface of the first tab extends rearwardly from the rearward face of the transverse wall one of horizontally or upwardly with respect to the horizontal centerline, and the second flat upper surface of the second tab extends rearwardly from the rearward face of the transverse wall one of horizontally or upwardly with respect to the horizontal centerline.

2. The lacrosse head of claim 1, wherein, when viewed from the side view, the first flat upper surface of the first tab and the second flat upper surface of the second tab lie in a horizontal plane parallel to the horizontal centerline.

3. The lacrosse head of claim 1, wherein, when viewed from the side view, the first flat upper surface of the first tab and the second flat upper surface of the second tab are upwardly inclined in the forward-to-rearward direction with respect to the horizontal centerline.

4. The lacrosse head of claim 1, further comprising a pocket strung to the first outer pocket member opening, the at least one inner pocket member opening, and the second outer pocket member opening, wherein the first rearward edge of the first tab supports a first pocket stringing member of the pocket, the third rearward edge of the at least one inner pocket member opening supports a second pocket stringing member of the pocket, and the second rearward edge of the second tab supports a third pocket stringing member of the pocket, so as to form a cylindrically-shaped channel in the pocket.

5. The lacrosse head of claim 4, wherein, when viewed from the side view, each of the first sidewall and the second sidewall has a rearward lower edge portion, a forward lower edge portion, and an intermediate lower edge portion between the rearward lower edge portion and the forward lower edge portion, wherein the pocket is strung to the first sidewall and the second sidewall, wherein, when viewed from the side view, the intermediate lower edge portion descends with respect to the horizontal centerline from the rearward lower edge portion in the rearward-to-forward direction to a maximum depth, wherein, when viewed from the side view, the forward lower edge portion ascends with respect to the horizontal centerline from the maximum depth in the rearward-to-forward direction, wherein the intermediate lower edge portion holds the pocket so that the pocket descends to a sweet spot below a transition point between the intermediate lower edge portion and the forward lower edge portion, and wherein the forward lower edge portion holds the pocket so that the pocket ascends from the sweet spot to the cylindrically-shaped pocket channel.

6. The lacrosse head of claim 5, wherein the rearward lower edge portion defines at least three stringing openings to which the pocket is attached, wherein, when viewed from the side view, the rearward lower edge portion extends parallel to the horizontal centerline for the at least three stringing openings such that the at least three stringing openings are arranged in a line parallel to the horizontal centerline, and wherein, when viewed from the side view, the rearward lower edge portion is disposed above the intermediate lower edge portion and the stop member.

7. The lacrosse head of claim 1, wherein the inner member and the outer member increase in transverse cross-sectional area in the rearward-to-forward direction.

8. The lacrosse head of claim 1, wherein each of the forward end of the inner member and the forward end of the outer member has a flared portion that curves downwardly into the rearward face of the transverse wall.

9. The lacrosse head of claim 7, wherein the inner member and the outer member are disposed above a continuous rearward edge of the transverse wall.

10. The lacrosse head of claim 7, wherein the inner member of the first tab and the inner member of the second tab are angled outwardly in the forward-to-rearward direction, and wherein the inner member of the first tab, the inner member of the second tab, and a rearward edge of the transverse wall define an upper perimeter of a pocket channel.

11. The lacrosse head of claim 7, wherein each of the first tab and the second tab has a brace member that is attached to a forward end of the outer member, and that, when viewed from the front view, extends laterally outward with respect to the bisecting line along the rearward face of the transverse wall, and is continuously attached to the rearward face of the transverse wall.

12. The lacrosse head of claim 11, wherein the brace member decreases in transverse cross-sectional area down to a point at a lateral end of the brace member.

13. The lacrosse head of claim 1, wherein the first rearward edge of the first tab and the second rearward edge of the second tab are concave when viewed from the front view.

14. The lacrosse head of claim 1, wherein, when viewed from the side view, the transverse wall defines an upper edge that is flat and is disposed continuously within a plane parallel to the horizontal centerline from the first shoulder portion to the second shoulder portion.

15. A lacrosse head, comprising:

a juncture configured to receive a handle, wherein a majority length of the handle defines a horizontal centerline of the handle and the lacrosse head when the lacrosse head is viewed from a side view and defines a bisecting line of the lacrosse head when the lacrosse head is viewed from a front view;

a stop member adjoining the juncture;

a first sidewall extending from the stop member in a rearward-to-forward direction;

a second sidewall extending from the stop member in the rearward-to-forward direction;

a transverse wall connecting the first sidewall and the second sidewall opposite to the stop member and defining a terminal contact point along the bisecting line, wherein the stop member, the transverse wall, the first sidewall, and the second sidewall form a frame defining a pocket area, the frame extending in the rearward-to-forward direction from a rearward end at the juncture to a forward end at the transverse wall, wherein the transverse wall and the first sidewall adjoin each other to form a first shoulder portion of the frame on a first side of the bisecting line, and the transverse wall and the second sidewall adjoin each other to form a second shoulder portion of the frame on a second side of the bisecting line opposite to the first side, wherein, when viewed from the side view, each of the first sidewall and the second sidewall has a rearward lower edge portion, a forward lower edge portion, and an intermediate lower edge portion that descends with respect to the horizontal centerline in the rearward-to-forward direction from the rearward lower edge portion to the forward lower edge portion, wherein the rearward lower edge portion, the forward lower edge portion, and the intermediate lower edge portion define stringing openings configured to receive a pocket, wherein, when viewed from the side view, the rearward lower edge portion extends parallel to the horizontal centerline for at least three stringing openings such that the at least three stringing openings are arranged in a line parallel to the horizontal centerline, wherein, when viewed from the side view, the rearward lower edge portion is disposed above the intermediate lower edge portion and the stop member, wherein the intermediate lower edge portion descends at an angle within a range of about 8 degrees to about 20 degrees with respect to the horizontal centerline, from the rearward lower edge portion in the rearward-to-forward direction to a maximum depth, wherein the terminal contact point is disposed a distance vertically above the maximum depth within a range of about 58 mm to about 67 mm, wherein the forward lower edge portion ascends at an angle within a range of about 35 degrees to about 55 degrees with respect to the horizontal centerline, from the maximum depth in the rearward-to-forward direction, wherein the intermediate lower edge portion is configured to hold the pocket so that the pocket descends to a sweet spot below a transition point between the intermediate lower edge portion and the forward lower edge portion, and wherein the forward lower edge portion is configured to hold the pocket so that the pocket ascends from the sweet spot toward the transverse wall;

a first tab protruding rearwardly from a rearward face of the transverse wall into the pocket area and disposed between the bisecting line and the first shoulder portion, wherein the first tab defines a first outer pocket member opening and a first rearward edge configured to support a pocket stringing member routed through the first outer pocket member opening; and a second tab protruding rearwardly from the rearward face of the transverse wall into the pocket area and disposed between the bisecting line and the second shoulder portion, wherein the second tab defines a second outer pocket member opening and a second rearward edge configured to support a pocket stringing member routed through the second outer pocket member opening, wherein each of the first tab and the second tab has an inner member, an outer member, and a pocket thread support member connecting the inner member and the outer member, wherein the inner member and the outer member protrude from the rearward face of the transverse wall in a forward-to-rearward direction, and wherein a forward end of the inner member and a forward end of the outer member are inclined in the rearward-to-forward direction to match an angle of the rearward face of the transverse wall, wherein the transverse wall defines at least one inner pocket member opening that extends from the rearward face of the transverse wall to a forward face of the transverse wall, and when viewed from the front view, the at least one inner pocket member opening is disposed between the first outer pocket member opening and the second outer pocket member opening, and wherein the transverse wall defines a third rearward edge of the at least one inner pocket member opening configured to support a pocket stringing member routed through the at least one inner pocket member opening, wherein, when viewed from the front view, the transverse wall defines a rearward edge having a curved shape, wherein the first rearward edge of the first tab, the third rearward edge of the at least one inner pocket member opening, and the second rearward edge of the second tab lie on an arc shape, wherein, when viewed from the front view, the first rearward edge of the first tab and the second rearward edge of the second tab are disposed rearward of the rearward edge of the transverse wall such that the arc shape is more curved than the curved shaped of the rearward edge of the transverse wall, and wherein the arc shape is configured to hold the pocket with a cylindrically-shaped channel formed in the pocket, with the cylindrically-shaped channel leading in the forward-to-rearward direction to the sweet spot.

16. The lacrosse head of claim 15, wherein when viewed from the side view, the transverse wall defines an upper edge that is flat and is disposed continuously within a plane parallel to the horizontal centerline from the first shoulder portion to the second shoulder portion.

17. The lacrosse head of claim 15, wherein when viewed from the side view:

the first tab defines a first upper surface that extends in the forward-to-rearward direction from a first upper forwardmost edge at the rearward face of the transverse wall, to the first rearward edge, the upper forwardmost edge of the first tab is disposed a first distance above the horizontal centerline, the first rearward edge of the first tab is disposed at a second distance above the horizontal centerline, and the second distance is equal to or greater than the first distance.

18. A lacrosse stick, comprising:

a handle; and a head including a juncture in which the handle is disposed, wherein a majority length of the handle defines a horizontal centerline of the handle and the lacrosse head when the lacrosse stick is viewed from a side view and defines a bisecting line of the lacrosse head when the lacrosse stick is viewed from a front view;

a stop member adjoining the juncture;

a first sidewall extending from the stop member in a forward direction;

a second sidewall extending from the stop member in the forward direction;

a transverse wall connecting the first sidewall and the second sidewall opposite to the stop member, wherein, when viewed from the front view, the transverse wall defines a rearward edge having a curved shape, wherein the stop member, the transverse wall, the first sidewall, and the second sidewall form a frame defining a pocket area, the frame extending in the forward direction from a rearward end at the juncture to a forward end at the transverse wall, wherein the transverse wall and the first sidewall adjoin each other to form a first shoulder portion of the frame on a first side of the bisecting line, and the transverse wall and the second sidewall adjoin each other to form a second shoulder portion of the frame on a second side of the bisecting line opposite to the first side, and wherein the transverse wall has a forward face and a rearward face;

a first tab protruding rearwardly from the rearward face of the transverse wall into the pocket area and disposed between the bisecting line and the first shoulder portion, wherein the first tab defines a first outer pocket member opening and a first rearward edge configured to support a pocket stringing member routed through the first outer pocket member opening, wherein, when viewed from the side view, the first tab defines a first flat upper surface that extends in a rearward direction from a first upper forwardmost edge at the rearward face of the transverse wall, to the first rearward edge; and a second tab protruding rearwardly from the rearward face of the transverse wall into the pocket area and disposed between the bisecting line and the second shoulder portion, wherein the second tab defines a second outer pocket member opening and a second rearward edge configured to support a pocket stringing member routed through the second outer pocket member opening, wherein each of the first tab and the second tab has an inner member, an outer member, and a pocket thread support member connecting the inner member and the outer member, wherein the inner member and the outer member protrude from the rearward face of the transverse wall in the rearward direction, and wherein a forward end of the inner member and a forward end of the outer member are inclined in the forward direction to match an angle of the rearward face of the transverse wall, wherein, when viewed from the side view, the second tab defines a second flat upper face that extends in the rearward direction from a second upper forwardmost edge at the rearward face of the transverse wall, to the second rearward edge, wherein the transverse wall defines at least one inner pocket member opening that extends from the rearward face to the forward face, and is disposed between the first outer pocket member opening and the second outer pocket member opening, and wherein the transverse wall defines a third rearward edge of the at least one inner pocket member opening configured to support a pocket stringing member routed through the at least one inner pocket member opening, wherein the first rearward edge of the first tab, the third rearward edge of the at least one inner pocket member opening, and the second rearward edge of the second tab lie on an arc shape, wherein, when viewed from the front view, the first rearward edge of the first tab and the second rearward edge of the second tab are disposed rearward of the rearward edge of the transverse wall such that the arc shape is more curved than the curved shaped of the rearward edge of the transverse wall, and wherein when viewed from the side view:

the first flat upper surface of the first tab extends rearwardly from the rearward face of the transverse wall one of horizontally or upwardly with respect to the horizontal centerline, and the second flat upper surface of the second tab extends rearwardly from the rearward face of the transverse wall one of horizontally or upwardly with respect to the horizontal centerline.

* * * * *